US007174124B2

(12) United States Patent
Ishibashi et al.

(10) Patent No.: US 7,174,124 B2
(45) Date of Patent: Feb. 6, 2007

(54) TANDEM COLOR IMAGE FORMING APPARATUS WITH AN IMAGE TRANSFER BELT AND BACKUP ROLLER

(75) Inventors: Hitoshi Ishibashi, Kanagawa (JP); Takayuki Maruta, Kanagawa (JP); Yuuji Sawai, Kanagawa (JP); Takahiro Yoshikawa, Kanagawa (JP); Atsushi Takehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 112 days.

(21) Appl. No.: 10/660,699

(22) Filed: Sep. 12, 2003

(65) Prior Publication Data

US 2004/0109709 A1 Jun. 10, 2004

(30) Foreign Application Priority Data

Sep. 13, 2002 (JP) ..... 2002-267512
Oct. 4, 2002 (JP) ..... 2002-292095

(51) Int. Cl.
*G03G 15/01* (2006.01)

(52) U.S. Cl. ..... 399/302

(58) Field of Classification Search ..... 399/302, 399/303, 308, 312, 299, 306, 66
See application file for complete search history.

(56) References Cited

U.S. PATENT DOCUMENTS 5,697,015 A 12/1997 Ream et al.
5,701,568 A * 12/1997 Hiroshima et al. ..... 399/302
5,701,569 A * 12/1997 Kanazawa et al. ..... 399/308
5,794,110 A * 8/1998 Kasai et al. ..... 399/299
5,978,617 A * 11/1999 Takano et al. ..... 399/61
6,021,286 A * 2/2000 Kawai et al. ..... 399/45
6,201,943 B1 * 3/2001 Asakura et al. ..... 399/297
6,324,374 B1 * 11/2001 Sasamoto et al. ..... 399/298
6,360,065 B1 3/2002 Ishibashi et al.
6,366,754 B1 4/2002 Sato et al.
6,405,002 B2 6/2002 Ogiyama et al.
6,470,161 B2 10/2002 Fujishiro et al.
6,501,914 B2 12/2002 Yoshikawa
6,505,022 B2 1/2003 Kosuge et al.
6,505,026 B2 1/2003 Hayakawa et al.

(Continued)

FOREIGN PATENT DOCUMENTS

JP 2001027850 A * 1/2001

(Continued)

OTHER PUBLICATIONS

Patent Abstracts of Japan, JP 11-095565, Apr. 9, 1999.

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus of the present invention disclosed is of the type sequentially transferring toner images from a plurality of photoconductive drums to a sheet being conveyed by an image transfer belt or an intermediate image transfer belt one above the other with bias applying members to thereby form a composite color image. Backup rollers, contacting the inside surface of the belt, each have volumetric resistivity of $10^9$ Ω·cm or above and ten-point mean surface roughness Rz of 6 μm or above.

36 Claims, 19 Drawing Sheets

U.S. PATENT DOCUMENTS

| | | | | |
|---|---|---|---|---|
| 6,535,707 | B2 | 3/2003 | Maruta et al. | |
| 6,546,219 | B2 | 4/2003 | Sato et al. | |
| 6,567,643 | B2 * | 5/2003 | Yasui et al. | 399/391 |
| 6,611,672 | B2 | 8/2003 | Aoki et al. | |
| 6,618,565 | B2 | 9/2003 | Sawai et al. | |
| 6,816,691 | B2 * | 11/2004 | Kabata et al. | 399/165 |
| 2002/0041781 | A1 | 4/2002 | Yasui et al. | |

FOREIGN PATENT DOCUMENTS

JP 2001312147 A * 11/2001

OTHER PUBLICATIONS

Patent Abstracts of Japan, JP 63-097976, Apr. 28, 1988.
Patent Abstracts of Japan, JP 2001-324883, Nov. 22, 2001.
U.S. Appl. No. 10/864,524, filed Jun. 10, 2004, Kato.
U.S. Appl. No. 10/861,440, filed Jun. 7, 2004, Sawai et al.
U.S. Appl. No. 10/798,382, filed Mar. 12, 2004, Ishibashi.
U.S. Appl. No. 09/758,192, filed Jan. 12, 2001, Sato et al.
U.S. Appl. No. 09/764,261, filed Jan. 19, 2001, Yoshikawa.
U.S. Appl. No. 09/947,391, filed Sep. 7, 2001, Kawagoe et al.
U.S. Appl. No. 10/114,265, filed Apr. 3, 2002, Maruta.
U.S. Appl. No. 10/178,685, filed Jun. 25, 2002, Sugino et al.
U.S. Appl. No. 10/193,219, filed Jul. 12, 2002, Takahashi.
U.S. Appl. No. 10/193,240, filed Jul. 12, 2002, Sawai.
U.S. Appl. No. 10/214,595, filed Aug. 9, 2002, Sakamoto.
U.S. Appl. No. 10/246,623, filed Sep. 19, 2002, Kamiyama.
U.S. Appl. No. 10/263,802, filed Oct. 4, 2002, Ishibashi et al.
U.S. Appl. No. 10/282,039, filed Oct. 29,2002, Ogiyama et al.
U.S. Appl. No. 10/315,111, filed Dec. 10, 2002, Sato et al.
U.S. Appl. No. 10/322,600, filed Dec. 19, 2002, Enoki et al.
U.S. Appl. No. 10/342,370, filed Jan. 15, 2003, Namiki et al.
U.S. Appl. No. 10/373,050, filed Feb. 26, 2003, Yoshikawa et al.
U.S. Appl. No. 10/375,115, filed Feb. 28, 2003, Yamanaka et al.
U.S. Appl. No. 10/389,979, filed Mar. 18, 2003, Ogiyama et al.
U.S. Appl. No. 10/660,699, filed Sep. 12, 2003, Ishibashi et al.
U.S. Appl. No. 11/276,666, filed Mar. 09, 2006, Takehara et al.
U.S. Appl. No. 11/354,146, filed Feb. 15, 2006, Yoshikawa.

* cited by examiner

TANDEM COLOR IMAGE FORMING APPARATUS WITH AN IMAGE TRANSFER BELT AND BACKUP ROLLER

BACKGROUND OF THE INVENTION

1. Field of the Invention

The present invention relates to a laser beam printer or similar tandem color image forming apparatus using an image transfer belt or an intermediate image transfer belt and more particularly to the characteristics of high-resistance backup rollers each contacting the inner surface of the belt.

2. Description of the Background Art

Today, to meet the increasing demand for high speed, advanced function color image formation, a direct image transfer type of tandem color image forming apparatus is predominant over an indirect type of color image forming apparatus using an intermediate image transfer body. The direct image transfer type of apparatus sequentially transfers toner images of different colors from a plurality image carriers arranged side by side to a sheet or recording medium being conveyed by an image transfer belt one above the other. This type of image forming apparatus, disclosed in Japanese Patent Laid-Open Publication No. 2001-324883 by way of example, includes a first to a fourth image forming station each being assigned to a particular color.

It is a common practice to output various applications edited by a personal computer or print images picked up by a digital camera in color. An image forming apparatus is therefore is used by various users not only in air-conditioned offices but also in other various environments. It follows that an image forming apparatus is required to deal with various kinds of recording media, including plain papers and coated papers, and various kinds of temperature and humidity environments. Further, an image forming apparatus compact enough to be handled by any user is desired.

The direct image transfer type of apparatus has the following problem although it is far higher in print speed than the indirect image transfer type of apparatus. In the direct image transfer type of apparatus, every time a sheet, electrostatically adhered to the image transfer belt, is passed through an image transfer nip formed in each image forming station, the sheet is charged due to separation discharge occurring between the sheet and the image carrier. The sheet is therefore charged up little by little as it advances toward the downstream image forming station. As a result, when a strong electric field is formed by an image transfer bias at the inlet of the nip of the next image forming station where the sheet is spaced from the image carrier, it is likely that a toner image carried on the sheet is scattered by pretransfer. This is particularly true when the image carrier is provided with a small diameter for reducing the overall size of the apparatus, because a nip between the image carrier and a bias applying member decreases in width.

To solve the above problem, Japanese Patent Laid-Open Publication No. 63-97976, for example, teaches a monochromatic image forming apparatus in which a press roller causes a sheet to contact a photoconductive drum before it is subject to the strong electric field of an image transfer bias. Further, the press roller is implemented as a conductive roller connected to ground in order to weaken the electric field at the inlet of an image transfer nip. However, such a conductive press roller is not directly applicable to the direct image transfer type of apparatus for reasons to be described hereinafter.

In the monochromatic apparatus taught in the above document in which a toner image is absent on a sheet when the sheet enters the image transfer nip, the press roller can be made conductive in order to weaken the electric field at the inlet of the nip as far as possible. However, in the direct image transfer type of tandem configuration, a toner image is present on a sheet when the sheet is conveyed to any one of the second and successive image forming stations. Therefore, as the sheet approaches the conductive press roller at the next image forming station, the electric field of toner on the sheet sharply decreases from infinity. Consequently, when the gap between the toner and the press roller connected to ground exceeds a discharge limit represented by the Paschen's law, discharge occurs and scatters the toner. Such toner scattering occurs in, among others, an RGB (red, green and blue) or similar bicolor line image. To solve this problem, in the direct image transfer type of tandem configuration, the roller at the inlet of the nip should not be conductive, but should preferably be provided with some resistance, i.e., insulative. More specifically, the roller should preferably be implemented as a high resistance roller.

However, when the high resistance press roller is held in contact with the image transfer belt whose volumetric resistance is as high as $10^{10}$ Ω·cm or above, frictional charging occurs between the press roller and the belt when the belt is in movement. When the resulting charge deposited on the press roller exceeds a certain limit, abnormal discharge also occurs. If a sheet is present on the image transfer belt when abnormal discharge occurs, the potential of the sheet varies from a portion subjected to the discharge to the other portion surrounding it. As a result, when image transfer is effected at the next image forming station by the application of a bias, an electric field necessary for image transfer is not attainable only at the above portion subject to the discharge, resulting in an image defect, as determined by experiments.

The image defect mentioned above refers to the local omission of an image in the form of spots and conspicuous in a halftone image, among others. The local omission of an image is apt to occur in a low temperature, low humidity environment in which the resistance of the press roller and that of the image transfer belt increase and when the amount of charge to deposit on the sheet increases. The local omission therefore frequently occurs when, e.g., an image is printed on the reverse surface of a sheet, which has been subjected to fixation and therefore noticeably lowered in water content, in a duplex print mode or when use is made of an OHP (OverHead Projector) film or similar recording medium whose volumetric resistivity is as high as $10^{14}$ Ω·cm or above.

Further, the direct image transfer type of tandem configuration has other problems to be described hereinafter. While the image transfer belt is conveying a sheet, toner images are directly transferred from the image carriers to the sheet one above the other. Therefore, when the sheet being conveyed is subject to the conveying force of a registration roller pair, fixing roller or similar conveying member other than the image transfer belt, colors are shifted from each other due to a small difference in linear velocity between the conveying member and the belt. Color shift also occurs when the sheet skews due to a small difference in vector between the direction of movement of the sheet conveyed by the registration roller pair and that of the image transfer belt.

In light of the above, there has been proposed an indirect image transfer type of tandem image forming apparatus in which a plurality of image forming units, each including a respective image carrier and a respective developing device, are arranged side by side while facing an intermediate image transfer belt. In this type of apparatus, toner images of different colors are directly transferred from the image carriers to the intermediate image transfer belt one above the other by primary image transfer, completing a four-color image on the belt. The four-color image is then transferred from the intermediate image transfer belt to a sheet by secondary image transfer. Even this type of apparatus has the same problems as the directly image transfer type of apparatus, as will be described hereinafter.

The intermediate image transfer belt to which toner images of different colors are to be directly transferred should preferably include a surface layer whose surface resistivity is as high as $10^{12}$ Ω·cm$^2$, so that a bicolor text image, for example, is free from toner scattering ascribable to image transfer. Such high resistance, however, causes the intermediate image transfer belt to be charged by separation discharge that occurs between the belt and the image carriers at consecutive image transfer nips, resulting in toner scattering ascribable to pretransfer. This will be readily understood when the term "intermediate image transfer belt" is substituted for the term "sheet" stated earlier.

Further, the conductive press roller, connected to ground, stated previously cannot be directly applied to the indirect image transfer type of tandem configuration either. This will also re readily understood when the term "intermediate image transfer belt" is substituted for the term "sheet".

SUMMARY OF THE INVENTION

It is an object of the present invention to provide a tandem color image forming apparatus capable of obviating image defects likely to occur when an image is printed on the reverse side of a sheet in a duplex print mode or when use is made of an OHP film or similar high-resistance recording medium, particularly in a low humidity, environment, thereby insuring desirable image quality.

An image forming apparatus of the present invention disclosed is of the type sequentially transferring toner images from a plurality of image carriers to a sheet being conveyed by an image transfer belt one above the other with bias applying members to thereby form a composite color image. Backup rollers, contacting the inside surface of the belt, each have volumetric resistivity of $10^9$ Ω·cm or above and ten-point mean surface roughness Rz of 6 μm or above.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
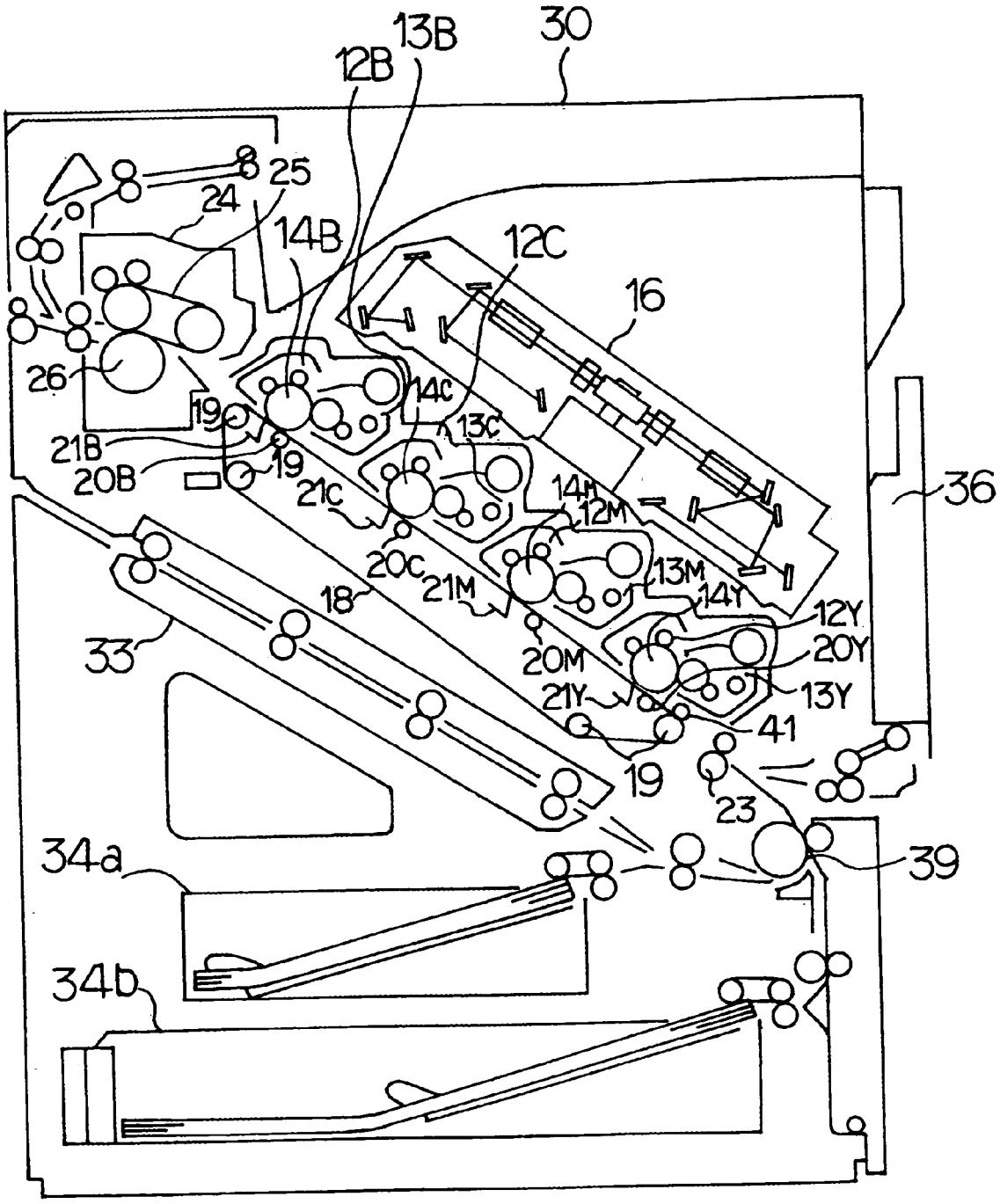
FIG. 1 is a view showing the general construction of a direct image transfer type of tandem color image forming apparatus embodying the present invention.

Referring to FIG. 1 of the drawings, a direct image transfer type of tandem color image forming apparatus embodying the present invention is shown. As shown, the color image forming apparatus includes two sheet cassettes or first and second sheet trays 34*a* and 34*b* and a manual sheet feed tray 36. A sheet or recording medium paid out from the sheet cassette 34*a* or 34*b* is conveyed to a registration roller pair 23 by a feed roller via an intermediate roller pair 39. A sheet paid out from the manual sheet feed tray 36 is directly conveyed by a feed roller to the registration roller pair 23.

A registration clutch, not shown, is coupled to cause the registration roller pair 23 to start conveying the sheet toward an image transfer belt 18 at such timing that the leading edge of the sheet meets toner images formed on photoconductive drums or image carriers 14Y (yellow), 14M (magenta) 14C (cyan) and 14B (black), which will be described later specifically. When the sheet arrives at a nip between the image transfer belt 18 and an adhesion roller 41 to which a bias applied, the sheet is electrostatically adhered to the belt 18. The sheet is then conveyed by the image transfer belt 18 at preselected process linear velocity of, e.g., 125 mm/sec.

Image transfer brushes 21Y, 21M, 21C and 21B are located to face the drums 14Y, 14M, 14C and 14Y, respectively, with the intermediary of the image transfer belt 18, and each is applied with an image transfer bias of positive polarity opposite to toner charged to negative polarity. As a result, a yellow, a magenta, a cyan and a black toner image formed on the drums 14Y through 14B, respectively, are sequentially transferred to the sheet, which is being conveyed by the image transfer belt 18, one above the other, completing a composite color image on the sheet. The sheet, carrying the color image thereon, is separated from the image transfer belt 18 on the basis of the curvature of a drive roller 19, which drives the belt 18, and then conveyed to a fixing unit 24. In the fixing unit 24, a fixing belt 25 and a press roller 26 fix the color image on the sheet while conveying the sheet. Subsequently, in the case of a simplex print mode, the sheet with the color image thus fixed is driven out to a print tray 30.

On the other hand, in a duplex print mode, the sheet, coming out of the fixing unit 24, is steered to a sheet turning unit, turned thereby and then conveyed to a duplex conveying unit 33 positioned below the image transfer belt 18. The duplex conveying unit 33 again conveys the sheet toward the registration roller pair 23 via the intermediate roller pair 39. This is followed by the same process as during the simplex print mode operation. Thereafter, the sheet, now carrying composite color images on both sides thereof, is driven out to the print tray 30 via the fixing unit 24.

In the illustrative embodiment, the consecutive image forming sections are made up of image forming units 12Y through 12K, respectively including the drums 14Y through 14B, charge rollers and cleaning portions, and developing units 13Y through 13B.

The operation of the illustrative embodiment will be described hereinafter. First, when the drums 14Y through 14B, each having an outside diameter as small as 30 mm, are driven by a main motor not shown, discharge rollers, respectively assigned to the drums 14Y through 14B and applied with an AC bias each, discharge the surfaces of the drums 14Y through 14B to a reference potential of substantially −50 V. The above AC bias does not include a DC component. Subsequently, an AC-biased DC bias of −500 V to −700 V is applied to charge rollers so as to charge the surfaces of the drums 14Y through 14B to a potential substantially equal to the DC component. As a result, the surfaces of the drums 14Y through 14B each are uniformly charged to −500 V to −700 V. It is to be noted that a target charge potential is determined by a process controller not shown.

Digital image data representative of a printer image are converted to bilevel LD (Laser Diode) emission signals color by color and then input to a writing unit 16, which include cylinder lenses, a polygonal mirror driven by an exclusive motor, fθ lenses, a first to a third mirror, and WTL lenses. The writing unit 16 scans the charged surfaces of the drums 14Y through 14B with laser beams modulated in accordance with the LD emission signals. The potential of part of each drum thus scanned imagewise varies to about −50 V, forming a latent image.

The developing units 13Y through 13B each include a respective developing sleeve to which an AC-biased DC voltage of −300 V to −600 V is applied. In this condition, toner of a particular color whose Q/M is between −20 C/g and −30 C/g is transferred from each sleeve to the latent image associated therewith, producing a corresponding toner image. In the illustrative embodiment, use is made of a two-component developer, i.e., a toner and carrier mixture for such development.

Toner images of different colors thus formed on the drums 14Y through 14B are sequentially transferred to the sheet by the following procedure. The image transfer brushes or bias applying members 21B through 21Y, respectively facing the drums 14Y through 14B with the intermediary of the image transfer belt 18, each are applied with an image transfer bias opposite in polarity to the toner. As a result, the toner images formed on the drums 14Y through 14B are sequentially transferred to the sheet electrostatically adhered to the image transfer belt 18, as stated earlier, one above the other.

Backup rollers 20Y through 20B, which characterize the illustrative embodiment, are included in an image transferring unit as auxiliary rollers for widening image transfer nips between the drums 14Y through 14B and the image transfer belt 18. The backup rollers 20Y through 20B each are positioned in the image forming unit by being biased by a spring.

In the illustrative embodiment, the backup rollers 20Y through 20B each include a metallic roller having a diameter of 6 mm. After 1 mm thick ABS (acrylonitrile-budadiene-styrene) resin with volumetric resistivity of $10^{15}$ Ω·cm to $10^{16}$ Ω·cm has been press-fitted in the outer periphery of the metallic roller to provide the roller with the final outside diameter of 8 mm, the surface of the resulting ABS resin layer is roughened by component rolling using a die. The thickness of the ABS resin layer was selected in accordance with the results of the following experiments.

<Experimental Conditions>

Environment: low temperature, low humidity (10° C., 15% RH)

Print mode: full-color duplex mode, second surface

Backup roller (A) metallic roller only (B) metallic roller+0.35 mm thick insulative tube (C) metallic roller+1 mm thick resin layer (embodiment)

Toner deposition control range (mg/cm$^2$):

lower limit (center value−0.1)

center value center value+0.1 upper limit (center value+0.2)

In all of the backup rollers (A) through (C), the diameter of the metallic roller was selected such that the final outside diameter was 8 mm.

Figure 2:
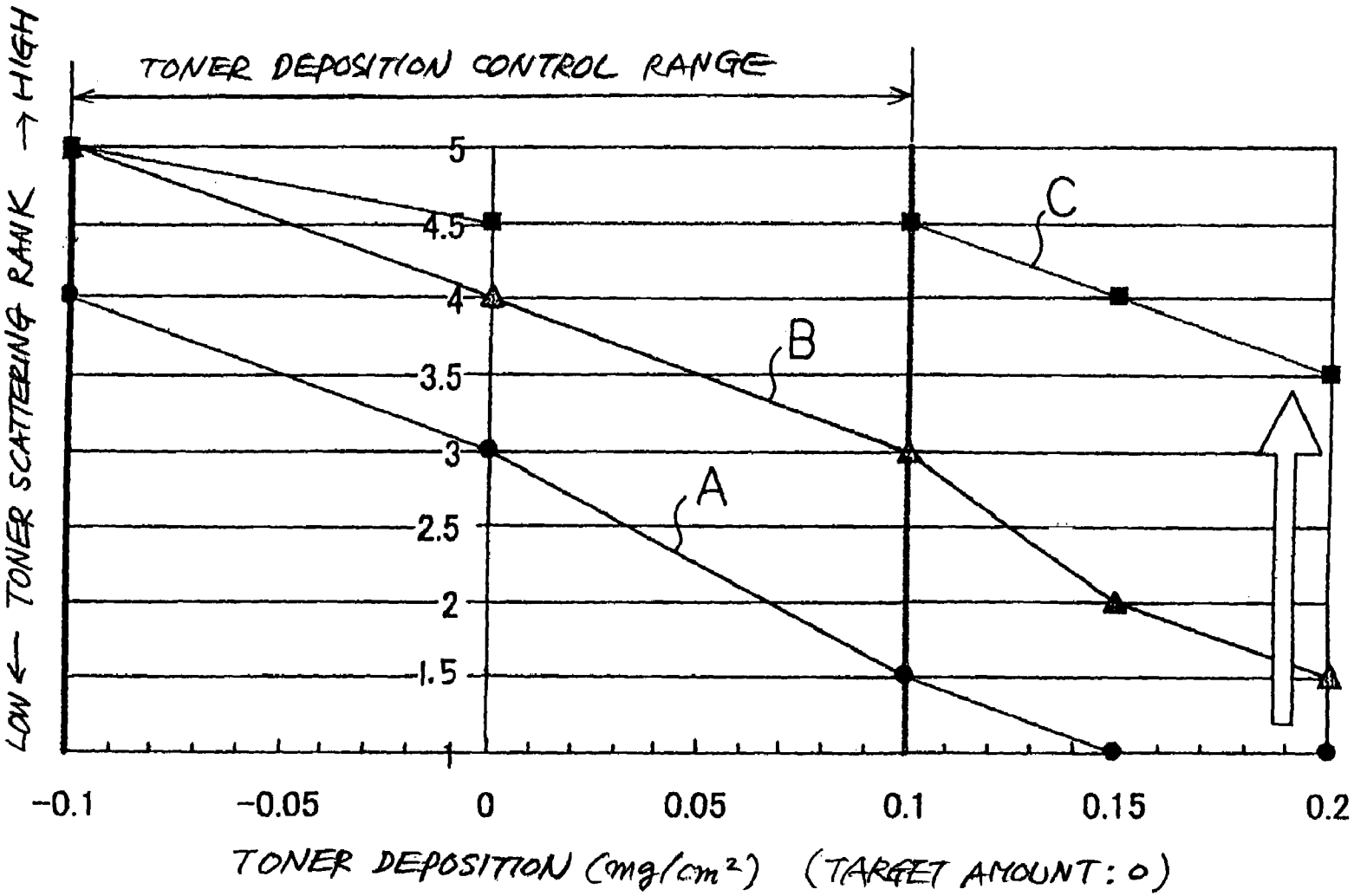
FIG. 2 is a graph showing a relation between the configuration of a backup roller included in the illustrative embodiment and toner scattering rank.
Figure 3:
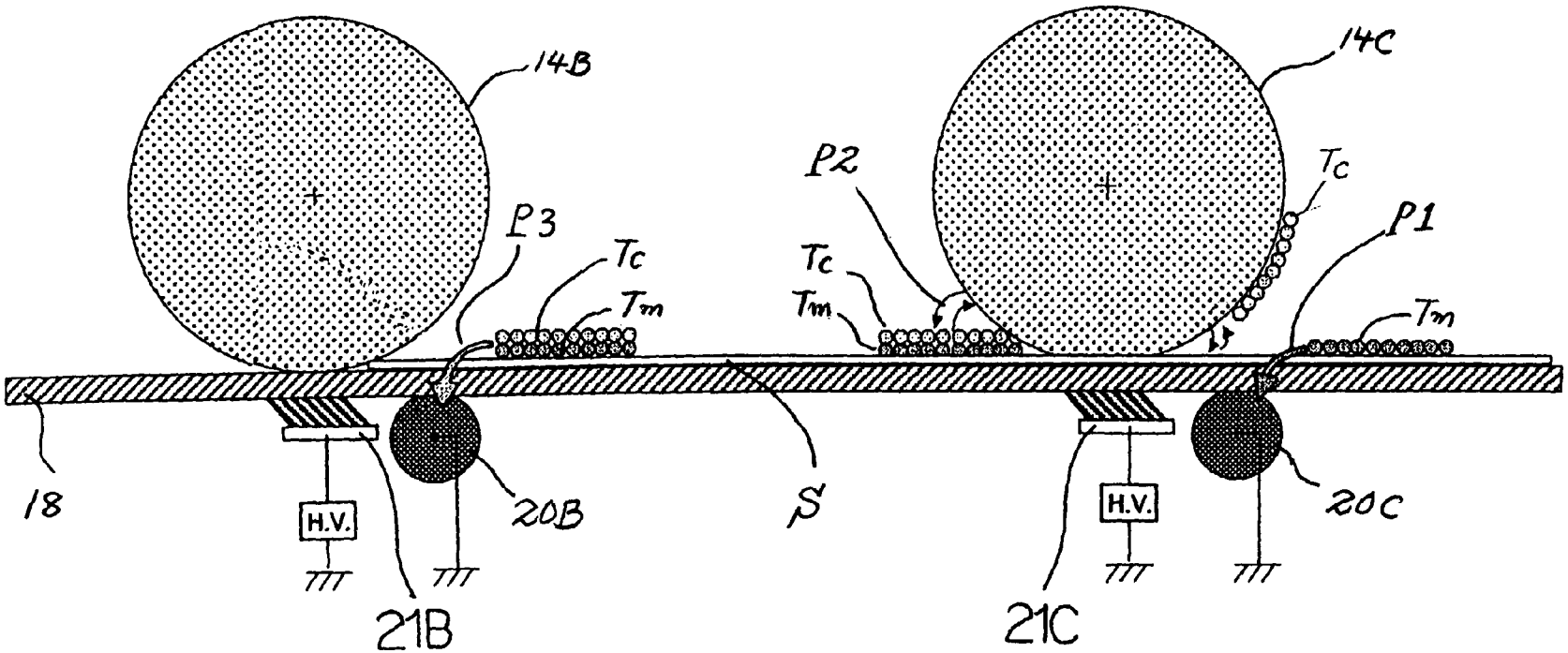
FIG. 3 is a view for describing why results shown in FIG. 2 occurred.

FIG. 2 shows the results of the above experiments. In FIG. 2, the abscissa indicates the toner deposition control range (mg/cm$^2$) while the ordinate indicates toner scattering ranks in nine consecutive levels including medium levels; the smaller the numerical value of the rank, the lower the degree of toner scattering. In FIG. 2, curves A, B and C correspond to the backup rollers (A), (B) and (C), respectively. It will be seen that the backup roller (A) is superior to the other backup rollers (B) and (C) as to toner scattering. This will be described more specifically with reference to FIG. 3. In FIG. 3, labeled P1 through P3 are positions relating to toner scattering.

A sheet S, moved away from the first or yellow image forming station, has been charged to negative polarity by separation discharge. More specifically, in the illustrative embodiment using a negative-to-positive developing system, toner of negative polarity is deposited on the drum charged to negative polarity and is then transferred to the sheet S by the positive image transfer bias. As a result, negative charge are discharged from the drum to the sheet S by separation discharge occurring at the image transfer nip.

At the second or magenta image forming station, toner Tm is transferred to the sheet S charged to negative polarity at the first image forming station, as stated above. At this instant, the negative toner on the sheet S and toner Tm repulse each other after image transfer and are therefore electrically extremely unstable. When such toner Tm on the sheet S approaches the metallic backup roller 20C, the electric field acting on the toner Tm sharply decreases from infinity. As a result, when the electric field acting on the toner exceeds a certain discharge limit derived from the Paschen's law, discharge occurs toward the backup roller 20C and causes the toner to be scattered at the position P1.

Subsequently, after cyan toner Tc has been transferred to the sheet S at the nip of the third or cyan image forming station, the sheet S and the cyan toner Tc deposited on the magenta toner Tm are further charged to negative polarity by separation discharge at the outlet P2 of the nip. At this instant, the toner portion, forming a text image, is charged to negative polarity more than the other portion surrounding it due to a difference in dielectric constant between the sheet S and the toner and therefore made electrically more unstable. In the case where the backup roller 20B, preceding the fourth or black image forming station, is implemented as a metallic roller, strong discharge also occurs at the position P3, further aggravating toner scattering.

By contrast, the backup roller with an insulative tube or with a resin layer thicker than the insulative tube has its distance to ground increased and is therefore provided with a larger margin as to abnormal discharge. More specifically, as FIG. 2 indicates, when the resin layer was 1 mm thick, images, belonging to the acceptable rank 4.5 or above, were achieved.

In light of the above, images were printed under various conditions by use of the backup roller made up of the metallic roller having a diameter of 6 mm and 1 mm thick ABS resin layer. However, it was found that in a low humidity environment, when a black halftone image was printed on the second surface of a plain paper in a duplex print mode or on an OHP film, the halftone image was locally lost in the form of spots.

It was experimentally found that the spot-like local omission mentioned above was closely related to the surface roughness of the backup roller 20B located at the fourth or black image forming station. This will be described with reference to FIGS. 4 and 5.

Figure 4:
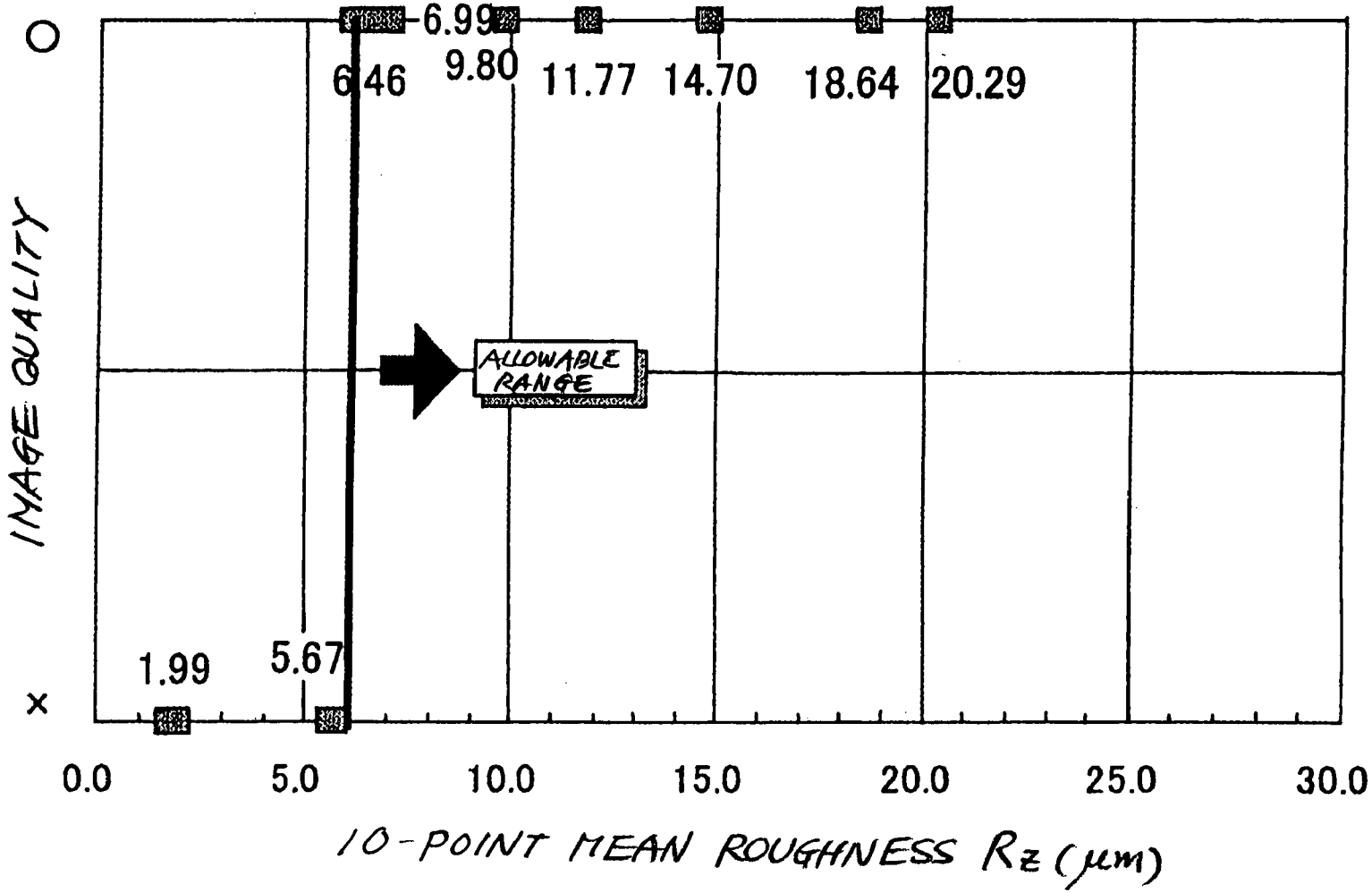
FIG. 4 is a graph showing a relation between the surface roughness Rz of the backup roller and image quality.
Figure 5:
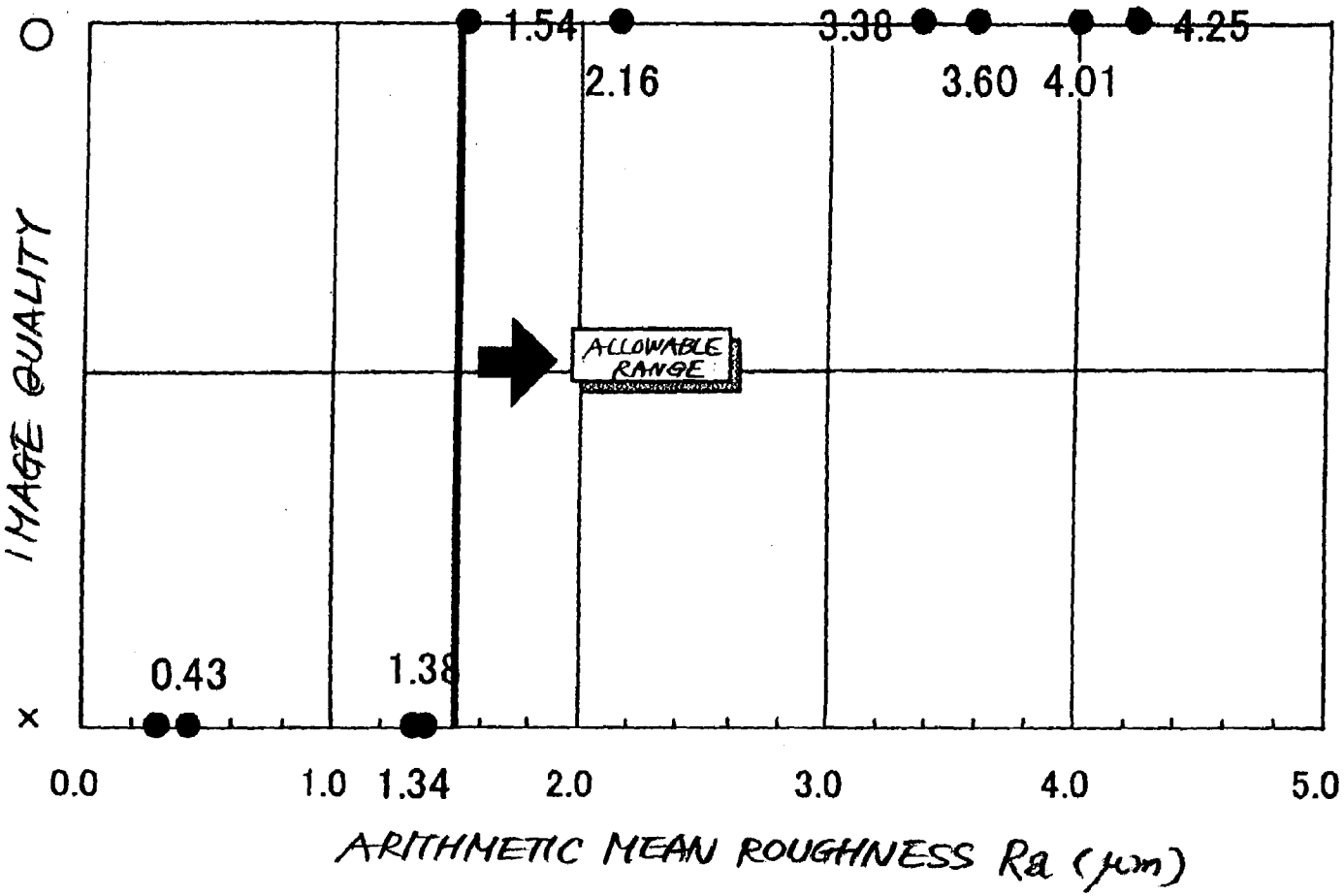
FIG. 5 is a graph showing a relation between the surface roughness Ra of the backup roller and image quality.

FIG. 4 shows a relation between the surface roughness Rz of the backup roller 20B in terms of ten-point mean roughness (abscissa) and the quality of an image (ordinate). Likewise, FIG. 5 shows a relation between the surface roughness Ra of the backup roller 20B in terms of arithmetic mean roughness (abscissa) and the quality of an image (ordinate). It will be seen that when the surface roughness of the backup roller 20B is 6 μm or above in Rz or 2.5 μm or above in Ra, the spot-like local omission of an image can be obviated.

Figure 6A:
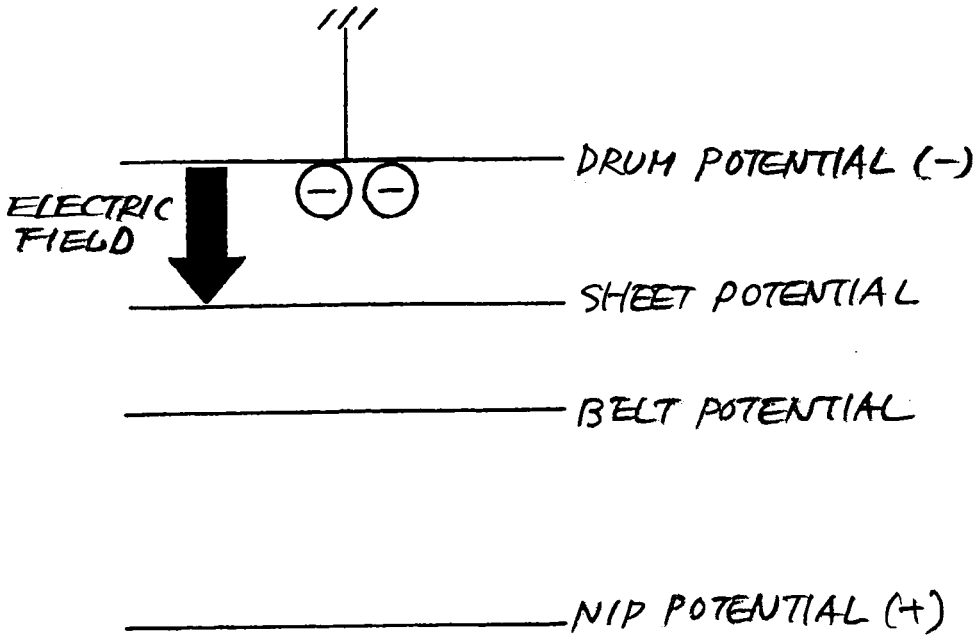
FIGS. 6A and 6B are views for describing why results shown in FIG. 5 occurred.
Figure 6B:
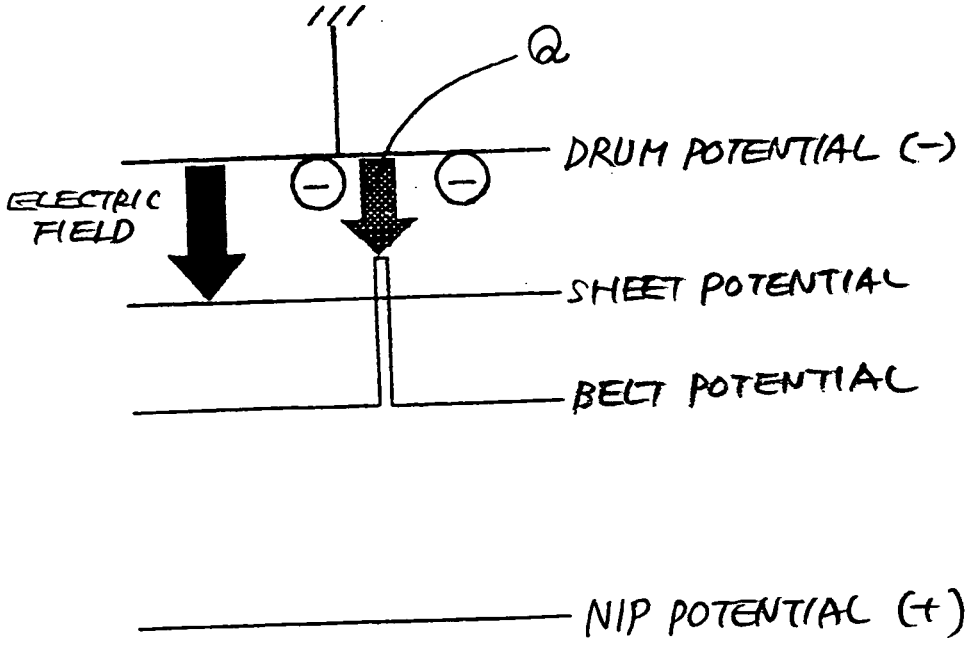

As stated above, the experiments showed that no image defects occurred when use was made of a metallic roller whose surface roughness Ra was as low as 0.3, that image defects occurred in a low humidity environment and on the second surface of a sheet in the duplex print mode, and that a black halftone image was locally lost due to abnormal discharge ascribable to the backup roller preceding the nip of the black image transfer nip. Consequently, as shown in FIGS. 6A and 6B, the inner surface of the image transfer belt presumably was locally charged to extremely intense negative polarity due to abnormal discharge at point Q ascribable to the frictional charging of the backup roller and image transfer belt; the roller and belt were charged to negative polarity and positive polarity, respectively. An electric field necessary for image transfer was not obtained at only the portions so charged, resulting in local omission.

Further, when the surface of the backup roller and that of the image transfer belt are extremely smooth, the threshold of the discharge limit between the backup roller and the image transfer belt rises, and therefore the amount of charge interchanged by one time of discharge is extremely large. Consequently, the image transfer belt is presumably more intensely charged to negative polarity, bringing about the image defect. Conversely, when a plurality of needle-like portions that are apt to discharge exist, discharge continuously occurs with small energy and therefore obviates a defective image.

Figure 7:
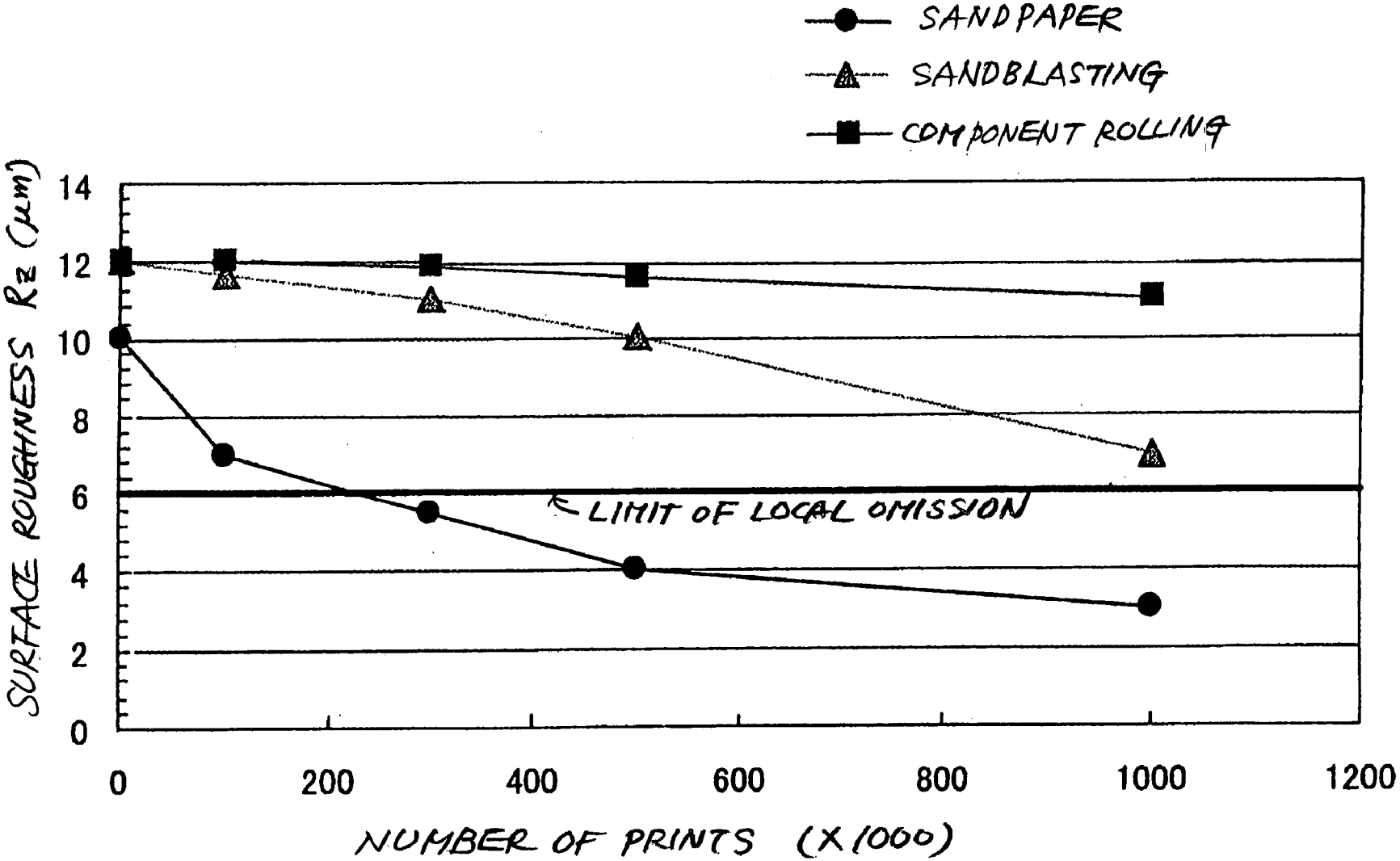
FIG. 7 is a graph showing a relation between the surface roughness Rz of the backup roller and durability thereof.

Durability tests based on the above analysis were conducted with backup rollers fabricated by various methods in order to compare them as to the ratio of spot-like local omission after the production of a given number of prints. FIG. 7 shows the results of the durability tests. As shown, the backup roller of the illustrative embodiment was lowest in the above ratio and therefore most durable. In FIG. 7, a curve with squares corresponds to the backup roller of the illustrative embodiment roughened by component rolling using a die.

As stated above, in the illustrative embodiment, the backup roller used to guarantee the image transfer nip is made up of a metallic roller and a 1 mm thick ABS resin layer having volumetric resistivity of $10^{15}$ Ω·cm and $10^{16}$ Ω·cm and press-fitted in the outer periphery of the metallic roller. The backup roller is then roughed by component rolling using a die to have surface roughness Rz of 12 μm. Such a backup roller was found to surely obviate toner the toner scattering of a two-color text image and the spot-like local omission of a black halftone image.

In the illustrative embodiment, the present invention is applied to the backup rollers or auxiliary rollers for forming image transfer nips at the inside of the loop of the image transfer belt. Presumably, by using discharge to occur between the backup roller and the image transfer belt, it is possible to discharge the image transfer belt. Therefore, the present invention may presumably be applicable even to rollers other than the backup rollers arranged in the image transferring unit for the purpose of effectively discharging the image transfer belt.

Further, in the illustrative embodiment, the backup rollers serve not only to guarantee the image transfer nips, but also to prevent the bristles of the image transfer brushes or bias applying members 21Y through 21B from collapsing due to the reaction of the image transfer belt. This function of the backup rollers is also available even when the image transfer brushes are replaced with Mylar sheets or blades by way of example.

Figure 8:
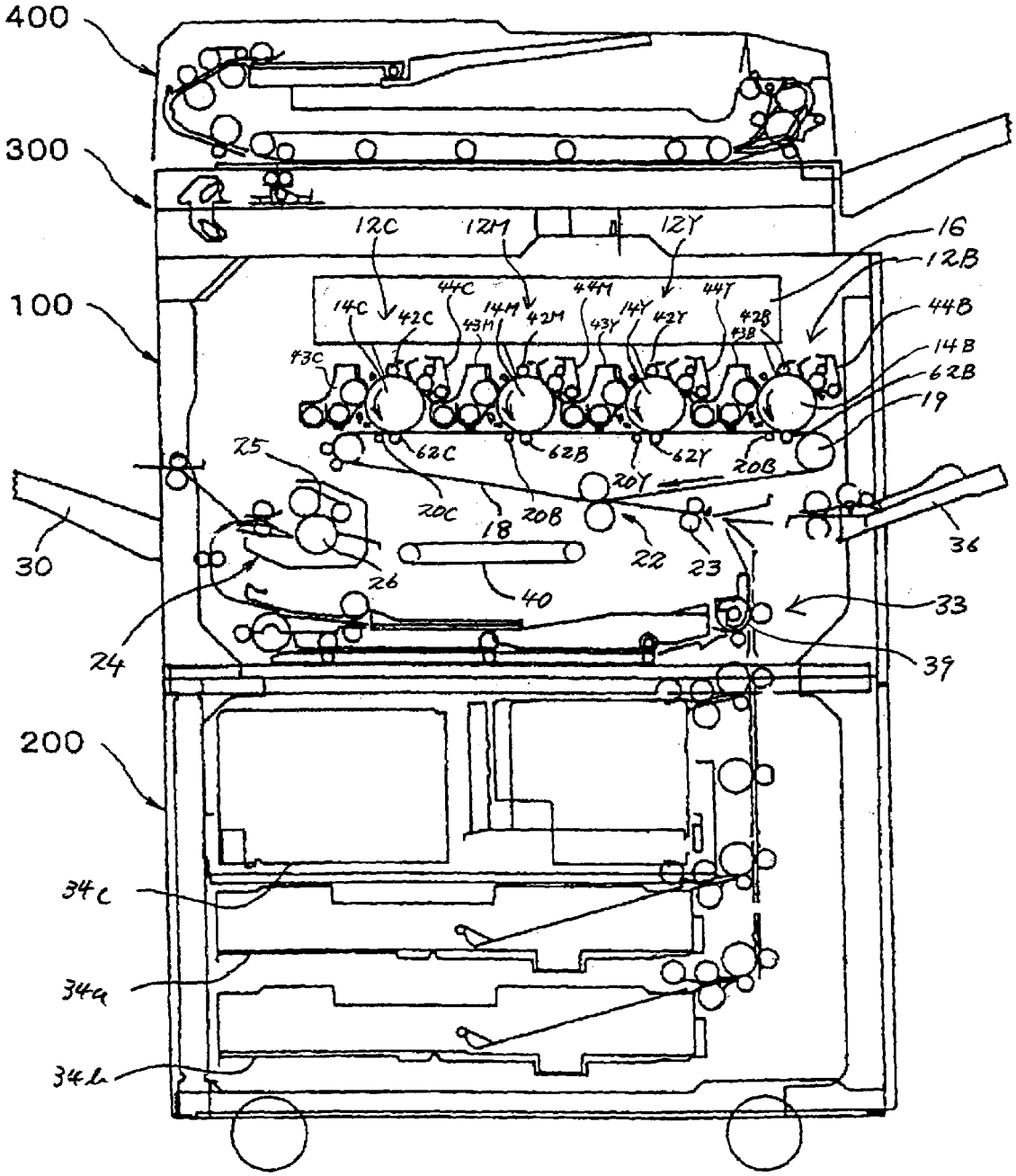
FIG. 8 is a view showing an alternative embodiment of the present invention implemented as an indirect image transfer type of tandem color image forming apparatus.

An alternative embodiment of the present invention will be described with reference to FIG. 8. As shown, the illustrative embodiment is implemented as an indirect image transfer type of tandem color image forming apparatus generally made up of an apparatus body 100, a sheet feed table 200 on which the apparatus body 100 is mounted, a scanner 300 positioned on the top of the apparatus body 100, and an ADF (Automatic Document Feeder) mounted on the top of the scanner 300.

In the illustrative embodiment, the image forming units 12C through 12B respectively include charge rollers 42C through 42B, developing units 43C through 43B, and cleaning devices 44C through 44B. In the illustrative embodiment, the image transfer belt 18 is replaced with an intermediate image transfer belt 18 while the backup rollers 20C through 20B each are provided with high resistance. Designated by the reference numeral 22 is a secondary image transfer position. The fixing unit 24 includes a fixing belt 25 and a press roller 26 pressed against the belt 25. A print tray 30 is substituted for the print tray 30 of the previous embodiment. The sheet feed table 200 includes three sheet trays 34*a* through 34*c*. There are also shown in FIG. 8 a belt conveyor 40 and image transfer rollers or bias applying members 62C through 62B. The other structural elements identical with or similar to the structural elements shown in FIG. 1 are designated by identical reference numerals and will not be described specifically in order to avoid redundancy.

More specifically, the drums 14C through 14B are arranged side by side in the direction of movement of the intermediate image transfer belt (simply belt hereinafter) 18, forming the first to fourth image forming stations, respectively. In the illustrative embodiment, the drums 14C through 14B each are provided with a diameter of 40 mm. The charge roller 42C, developing unit 43C and cleaning unit 44C are sequentially arranged around the drum 14C in the direction of movement of the drum 14C. The drum 14C contacts the belt 18 between the developing unit 43C and the cleaning device 44C and is pressed against the image transfer roller 62C by preselected pressure, forming a first image transfer position or nip. Such a configuration also applies to the members arranged around the other drums 14M, 14Y and 16B.

The secondary image transfer position 22 is positioned downstream of the fourth image forming station in the direction of movement of the belt 18 for transferring a composite color image to a sheet. The belt conveyor 40 is positioned below the belt 18 for conveying the sheet moved away from the secondary image transfer position 22. The fixing unit 24 is positioned downstream of the belt conveyor 40 while the print tray 30 is positioned downstream of the fixing unit 24.

In operation, when the drums 14C through 14B are driven by a main motor not shown, discharge rollers, respectively assigned to the drums 14C through 14B and applied with an AC bias each, discharge the surfaces of the drums 14C through 14B to a reference potential of substantially −50 V. The above AC bias does not include a DC component. Subsequently, an AC-biased DC bias of −500 V to −700 V is applied to the charge rollers 42C through 42B so as to charge the surfaces of the drums 14C through 14B to a potential substantially equal to the DC component. As a result, the surfaces of the drums 14C through 14B each are uniformly charged to −500 V to −700 V. It is to be noted that a target charge potential is determined by a process controller not shown.

A document image read by the scanner 300 is converted to bilevel LD emission signals color by color and then input to the writing unit 16. The writing unit 16 scans the surfaces of the drums 14C through 14B with laser beams modulated in accordance with the LD emission signals. As a result, the portions of the drums 14C through 14B scanned by the laser beams vary to substantially −50 V, forming latent images.

The developing units 43C through 43B each include a respective developing sleeve to which an AC-biased DC voltage of −300 V to −600 V is applied. In this condition, toner of a particular color whose Q/M is between −20 C/g and −30 C/g is transferred from each sleeve to the latent image associated therewith, producing a corresponding toner image. In the illustrative embodiment, too, use is made of a two-component developer for such development.

Subsequently, the image transfer rollers 62C through 62B, applied with an image transfer bias opposite in polarity to the toner each and constituting primary image transfer positions, sequentially transfer the toner images from the drums 14C through 14B to the belt 18 one above the other, completing a four- or full-color image on the belt 18.

The image transfer rollers 62C through 62B each are formed of an elastic material whose resistance lies in a so-called medium resistance range of from $10^6$ Ω·cm to $10^8$ Ω·cm. The image transfer rollers 62C through 62B are pressed against the belt 18 by preselected pressure selected to cause the roller surfaces to deform without permanent set when left non-used for a long time. Therefore, the allowable preselected pressure depends on the material, diameter and so forth of the image transfer rollers 62C through 62B. While such preselected pressure is, in many cases, implemented by springs biasing roller shafts, the illustrative embodiment maintains the distance between the axes of the drums 14C through 14B and those of the image transfer rollers 62C through 62B constant and implements the preselected pressure by using the elasticity of the rollers 62C through 62B.

The four-color image formed on the belt 18 is conveyed to the secondary image transfer position via a position where the belt 18 is passed over the drive roller 19. A sheet is fed from any one of the sheet cassettes 34*a* through 34*c* and manual sheet feed tray 36 to the secondary image transfer position and brought into contact with the belt 18 in movement. As a result, the four-color image is transferred from the belt 18 to the sheet by a preselected electric field. The sheet is then conveyed by the belt 18 to the fixing unit 24 and has the four-color image fixed thereon thereby. Finally, the sheet or print is driven out to the print tray 30.

In the illustrative embodiment, the backup rollers 20C through 20B, provided with high resistance, serve as auxiliary rollers for widening the image transfer nips between the drums 14C through 14B and the belt 18. The backup rollers 20C through 20B each are positioned in the image forming unit by being biased by a spring. More specifically, if each drum has a sufficiently large diameter, then the image transfer nip can, of course, be made wide enough to obviate the need for a backup roller. However, the current trend in the imaging art is toward a small size image forming apparatus including a drum whose diameter is as small as 40 mm or less. The drum with such a small diameter is apt to make the nip width short and therefore make image transfer defective because the pressure available with the image transfer bias applying member is limited, as stated earlier.

While the backup roller is located upstream of the image transfer nip, the backup roller should not be excessively remote from the nip because it is expected to widen the nip by pressing the belt 18 against the drum. If the backup roller 20M, for example, is excessively remote from the drum 14M and excessively close to the drum 14C, then the nip formed by the drum 14M is not widened to a noticeable degree although the nip formed by the drum 14C is widened. Although the backup roller 20Y makes up for the short nip formed by the drum 14M, the nip formed by the drum 14B at the fourth image forming station is not widened at all. The backup roller should therefore be positioned at the intermediate between the associated drum and the drum upstream of the same or closer to the associated drum.

In the illustrative embodiment, the drums 14C through 14B each have a diameter of 40 mm while the backup rollers 20C through 20B each include a metallic roller having a diameter of 6 mm. After 1 mm thick ABS resin with volume resistivity of $10^{15}$ Ω·cm to $10^{16}$ Ω·cm has been press-fitted in the outer periphery of the metallic roller to provide the roller with the final outside diameter of 8 mm, the surface of the resulting ABS resin layer is roughened by component rolling using a die. The thickness of the ABS resin layer was selected in accordance with the results of the following experiments. It is to be noted that the volume resistance of the resin is not limited to the above value, but should only be $10^{10}$ Ω·cm or above.

<Experimental Conditions>

Environment: low temperature, low humidity (10° C., 15% RH)

Print mode: full-color duplex mode, second surface

Backup roller (A) metallic roller only (B) metallic roller+0.35 mm thick insulative tube (C) metallic roller+1 mm thick resin layer Note: Metallic rollers are different in diameter, but have the same outside diameter of 8 mm.

Toner deposition control range (mg/cm$^2$):

lower limit (center value−0.1)

center value (target value)

center value+0.1 upper limit (center value+0.1)

(center value+0.15)

(center value+0.2)

Figure 9:
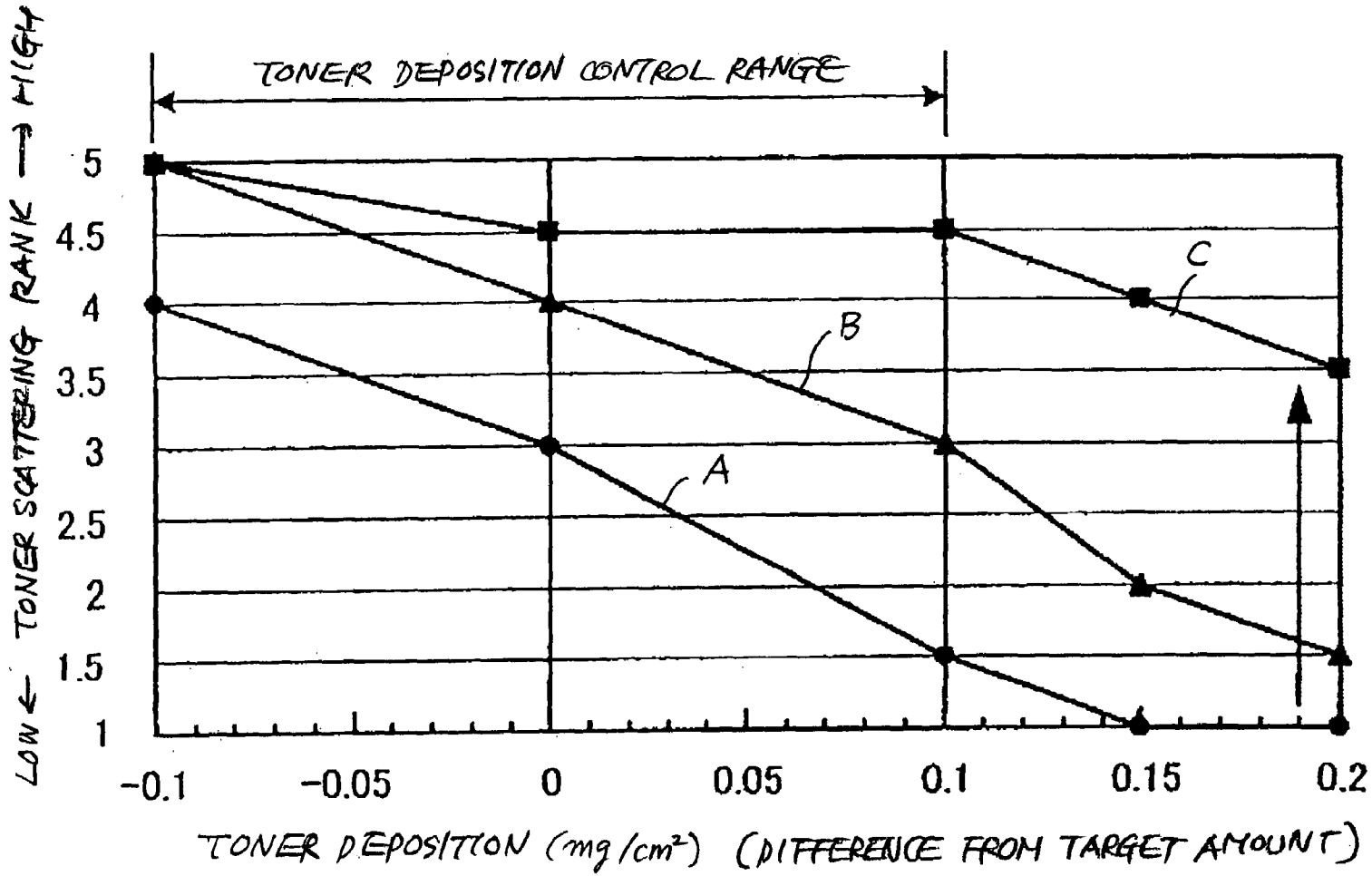
FIG. 9 is a graph showing a relation between the configuration of a backup roller included in the alternative embodiment and toner scattering rank.

FIG. 9 shows the results of the above experiments. More specifically, FIG. 9 shows the results of estimation of toner scattering determined by eye with respect to nine consecutive levels between the lowest rank 1 and the highest rank 5, including medium levels. Levels 3 and above are assumed to be acceptable in practical use.

As FIG. 9 indicates, in the case of the backup roller (A), toner scattering not acceptable in practical use occurred when the amount of toner deposition increased even if within the original control range. With the backup roller (B), toner scattering was confined in the acceptable range so long as the amount of toner deposition lied in the original control range. However, the estimation level was 3, which is the allowable limit, when the amount of toner deposition was +0.1 mg/cm$^2$ that is the upper limit of the control range. This condition is not satisfactory because toner scattering is likely to further increase, depending on the variation of factors not dealt with in the experiments.

Further, as for the backup roller (C), the estimation level was not noticeably lowered not only in the toner deposition control range but also in a range above the control range. It may therefore be safely concluded that if the amount of toner deposition lies at least in the control range, the toner scattering level immediately falls below the allowable range even when the other factors vary.

Figure 10:
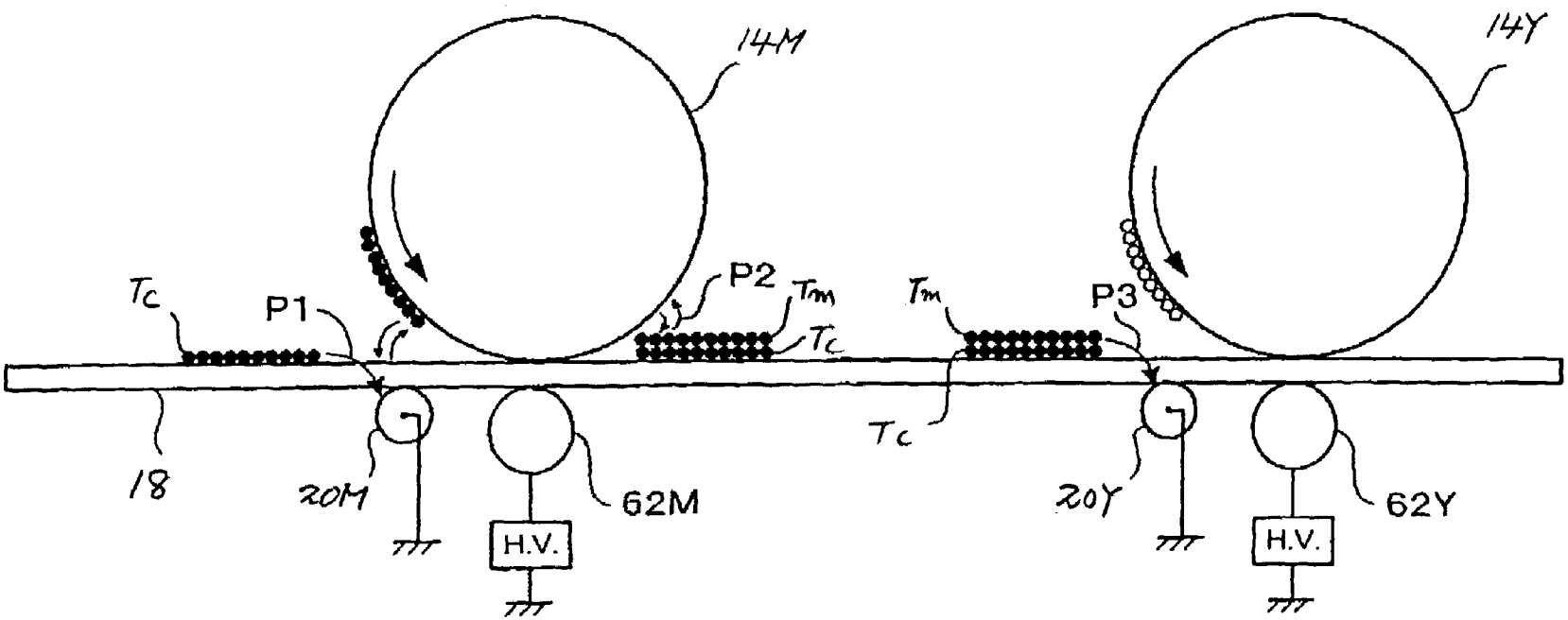
FIG. 10 is a view for describing why results shown in FIG. 9 occurred.

How toner scattering occurs will be described more specifically with reference to FIG. 10. In FIG. 10, labeled P1 through P3 are positions relating to toner scattering. The position P1 adjoins the backup roller 20M at the upstream side. The position P2 adjoins the outlet of the nip between the drum 14M and the belt 18. The position P3 adjoins the backup roller 20Y at the upstream side. In the following description, assume that the backup rollers 20C through 20B are implemented as simple metallic rollers.

The belt 18, moved away from the first or cyan image forming station, has been charged to negative polarity by separation discharge. More specifically, in the illustrative embodiment using a negative-to-positive developing system, toner of negative polarity is deposited on the drum charged to negative polarity and is then transferred to the belt 18 by the positive image transfer bias. As a result, negative charge is discharged from the drum to the belt 18 by separation discharge occurring at the image transfer nip.

At the second or magenta image forming station, toner of negative polarity is transferred to the belt 18 charged to negative polarity at the first image forming station, as stated above. At this instant, the negative toner on the belt 18 and the above toner repulse each other after image transfer and are therefore electrically extremely unstable. When cyan toner Tc deposited on the belt 18 and electrically unstable approaches the position P1 adjoining the metallic backup roller 20M, the electric field acting on the toner Tc sharply decreases from infinity. As a result, when the electric field exceeds a certain discharge limit derived from the Paschen's law, discharge occurs toward the backup roller 20M and causes the toner to be scattered.

When magenta toner Tm, transferred from the drum 14M to the belt 18 above the cyan toner Tc present on the belt 18, approaches the outlet P2 of the image transfer nip, the belt 18 and cyan toner Tc and magenta toner Tm present thereon are further charged to negative polarity due to the separation discharge of the belt 18. At this instant, the toner portion, forming a text image, is charged to negative polarity more than the other portion surrounding it due to a difference in dielectric constant between the belt 18 and the toner and therefore made electrically more unstable.

At the third or yellow image forming station, when the toner image approaches the position P3 close to the backup roller 20Y, discharge again occurs toward the backup roller 20Y when the electric field, acting on the toner, exceeds the discharge limit and causes the toner to be scattered.

As stated above, the negative charge of the toner portion is intensified little by little, rendering the toner portion electrically further unstable. If the backup roller 20B at the fourth or black image forming station is a metallic roller, then discharge of the same degree as or more intense than the previous discharge occurs, further aggravating toner scattering.

By contrast, the backup roller with an insulative tube or with a resin layer thicker than the insulative tube has its distance to ground increased and is therefore provided with a larger margin as to abnormal discharge. More specifically, as FIG. 9 indicates, when the resin layer was 1 mm thick, images, belonging to the acceptable rank 4.5 or above, were achieved.

As for the scattering of a composite color image, the surface resistivity of the belt 18 should preferably be as close to the resistivity (substantially insulation) of the toner as possible. In light of this, use was made of a belt having surface resistivity of $10^{12}$ Ω·cm or above.

When prints were produced under various conditions by use of the backup roller made up of the metallic roller having a diameter of 6 mm and 1 mm thick ABS resin layer, halftone images were also locally lost in the form of spots in a low humidity environment. It was experimentally found that the degree of such local omission was closely related to the surface roughness of the backup roller 20B located at the fourth image forming station.

Figure 11:
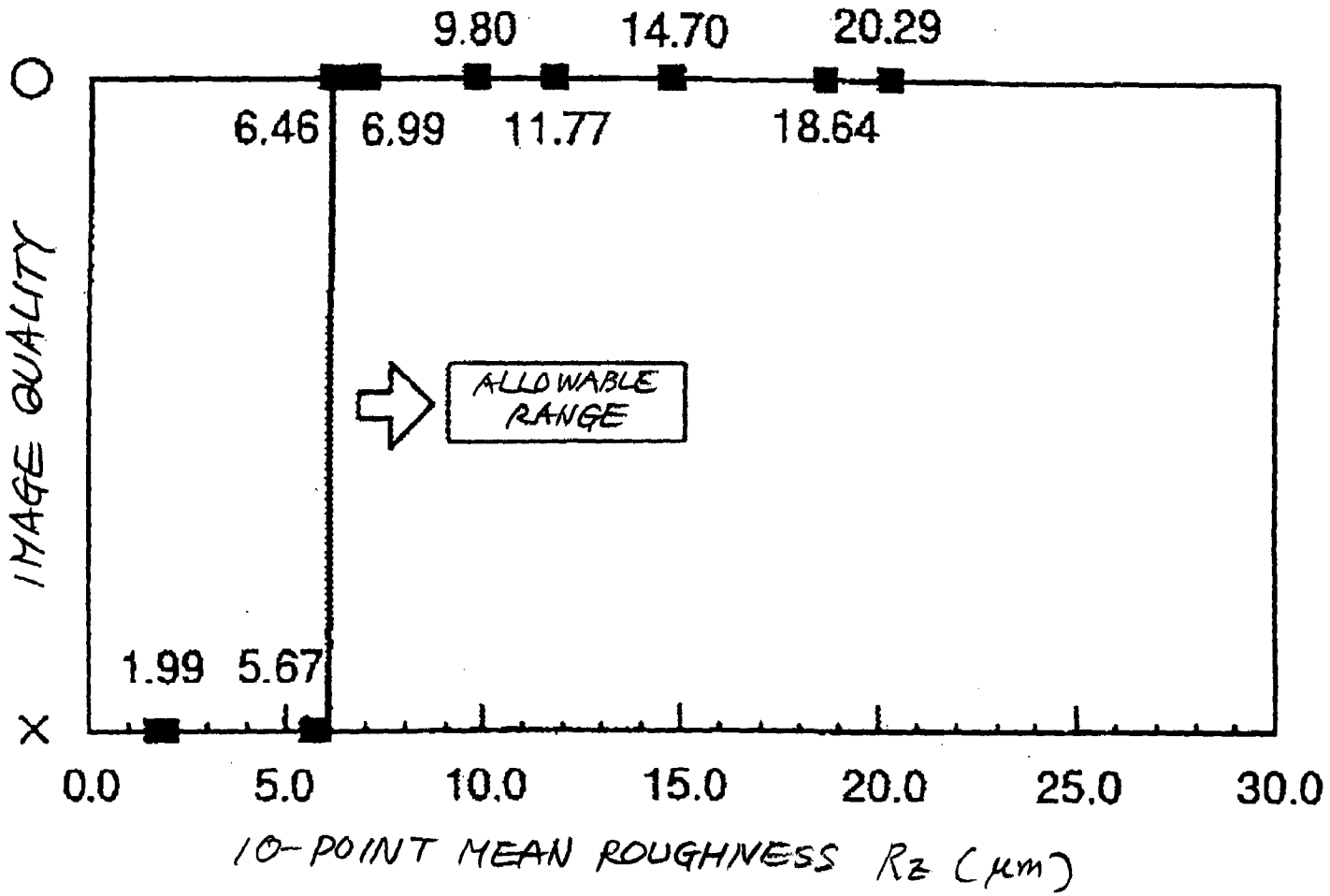
FIG. 11 is a graph showing a relation between the ten-point mean surface roughness Rz of the backup roller of the alternative embodiment and image quality.
Figure 12:
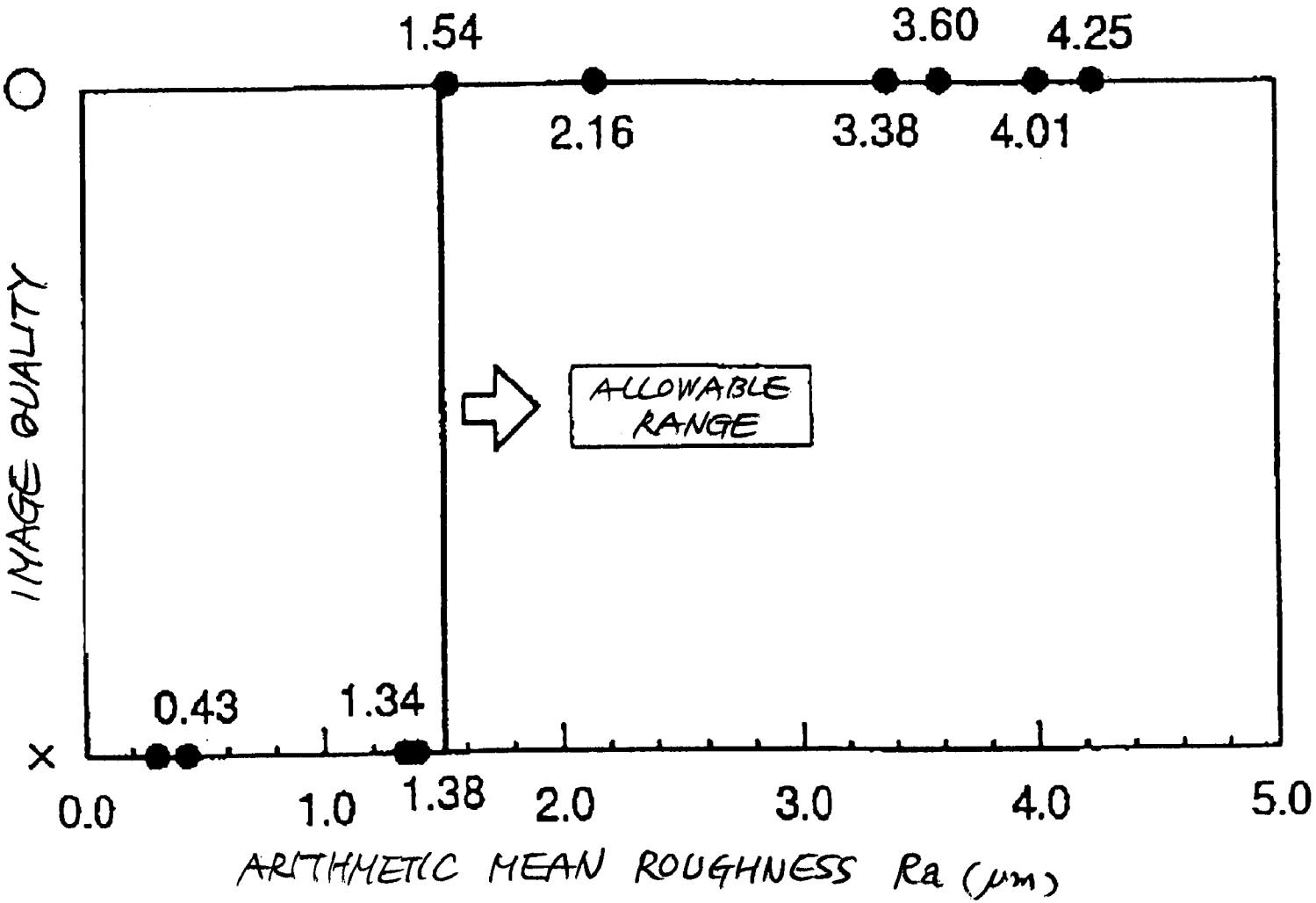
FIG. 12 is a graph showing a relation between the arithmetic mean surface roughness Ra of the backup roller and image quality.

FIG. 11 shows a relation between the surface roughness Rz of the backup roller 20B in terms of ten-point mean roughness (abscissa) and the quality of an image (ordinate). Likewise, FIG. 12 shows a relation between the surface roughness Ra of the backup roller 20B in terms of arithmetic mean roughness (abscissa) and the quality of an image (ordinate). Image quality was estimated in two levels, i.e., "o" and "x".

As FIG. 11 indicates, image quality was low when the surface roughness Rz of the backup roller 20B was 5.67 μm, but was high when it was 6.47 μm or above. More specifically, high image quality was achieved, i.e., local omission was obviated if the surface roughness Rz was substantially 6 μm or above. As FIG. 12 indicates, image quality was low when the surface roughness Ra was 1.38 μm, but was high when it was 1.54 μm, meaning that high image quality was achieved if the surface roughness Ra was substantially 1.5 μm or above. Sufficiently high image quality was attained when the maximum surface roughness Rz and Ra were respectively selected to be 20.29 μm and 4.25 μm at least for experiments.

It is known by experience that tone scattering does not occur when the backup roller is implemented as a metallic roller having extremely small surface roughness, i.e., Ra=0.3 μm. The cause of local omission will be described on the basis of this fact and the experimental results described above.

Figure 13A:
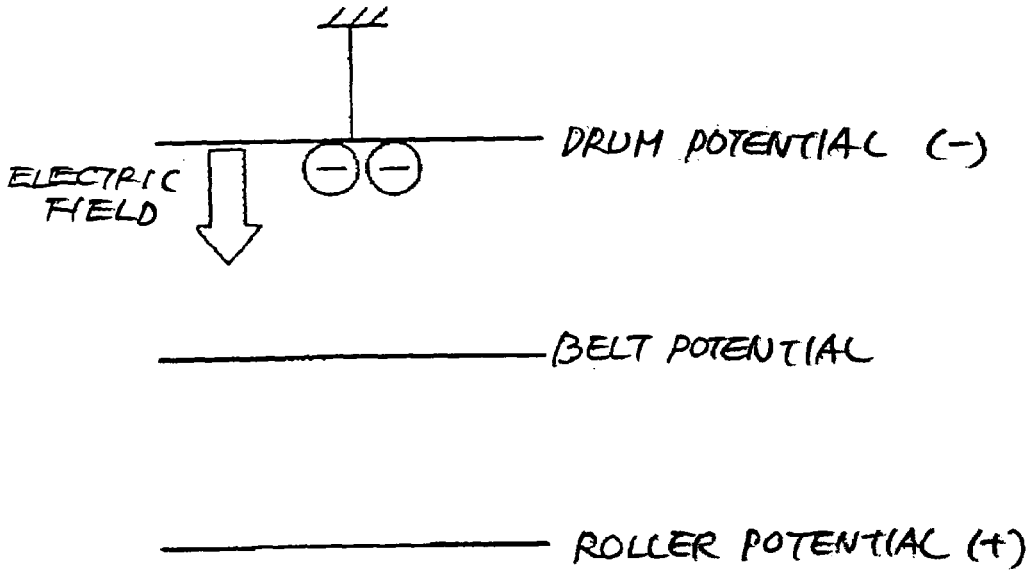
FIGS. 13A and 13B are views for describing why results shown in FIGS. 11 and 12 occurred.
Figure 13B:
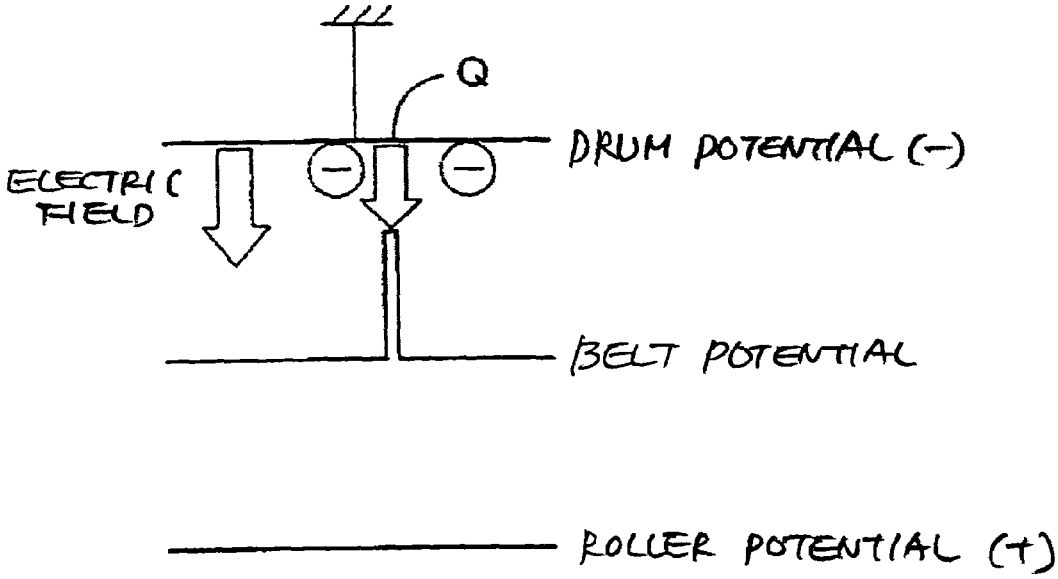

The experimental results indicate that the local omission occurs only in a low humidity environment and that part of a black halftone image is not transferred due to the abnormal discharge of the backup roller 20B that precedes the nip of the fourth image forming station. FIGS. 13A and 13B show a relation in potential between the drum and the belt around the nip. More specifically, FIGS. 13A and 13B respectively show a condition wherein the belt is not charged at all and a condition wherein it is locally intensely charged to negative polarity; bold arrows indicate lengths each being representative of a particular electric field level.

As shown in FIG. 13A, when the belt is not charged at all, a preselected electric field level for image transfer is guaranteed and effects expected image transfer. By contrast, as shown in FIG. 13B, assume that the backup roller and belt are respectively charged to negative polarity and positive polarity due to friction, and that the inner surface of the belt is locally intensely charged to negative polarity at a point Q due to abnormal discharge. Then, presumably the expected electric field level is not attained only at the intensely charged portion of the belt, failing to transfer an image.

Presumably, so long as the surface of the backup roller and that of the belt are extremely smooth, the threshold of the discharge limit rises and obstructs abnormal discharge between the backup roller and the belt.

When the surface of the backup roller and that of the image transfer belt have some, but small, roughness, the threshold of the discharge limit is also high and makes the amount of charge interchanged by one time of discharge extremely large. Consequently, the image transfer belt is presumably more intensely charged to negative polarity, bringing about the image defect. Conversely, when a plurality of needle-like portions that are apt to discharge exist, discharge continuously occurs with small energy and therefore obviates a defective image.

Figure 14:
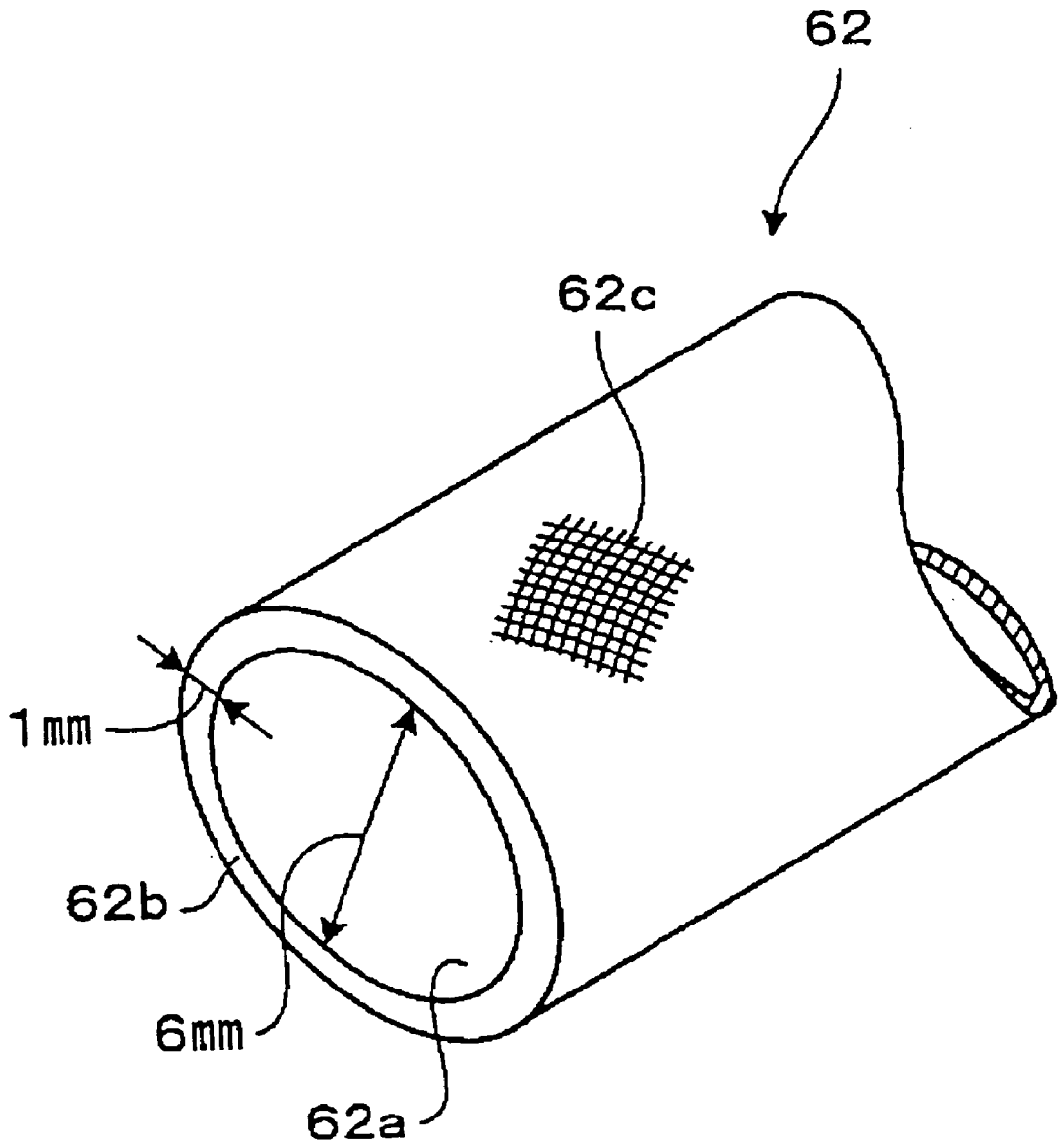
FIG. 14 is a fragmentary view showing a specific pattern formed on the backup roller by component rolling.

Durability tests based on the above analysis were conducted with backup rollers each having a surface roughened by a particular method. There were prepared backup rollers each consisting of a metallic roller and a 1 mm thick ABS resin layer having volumetric resistivity of $10^{15}$ Ω·cm to $10^{16}$ Ω·cm. The surfaces of such backup rollers each were roughened by sandpaper, sandblasting or component rolling using a die. FIG. 14 shows the surface of the backup roller 62 whose surface was roughened by component rolling in a crosshatch pattern. As shown, the backup roller 62 is made up of a metallic roller 62*a* having a diameter of 6 mm and a 1 mm thick ABS resin layer 62*b*. Only part of the crosshatch pattern is shown and labeled 62*c*.

To test durability, the above backup rollers each were mounted to an ordinary image forming apparatus including photoconductive drums each having a diameter of 40 mm. The relation between the local omission of an image and surface roughness was examined when 100,000 prints, 300,000 prints, 500,000 prints and 1,000,000 prints were produced.

Figure 15:
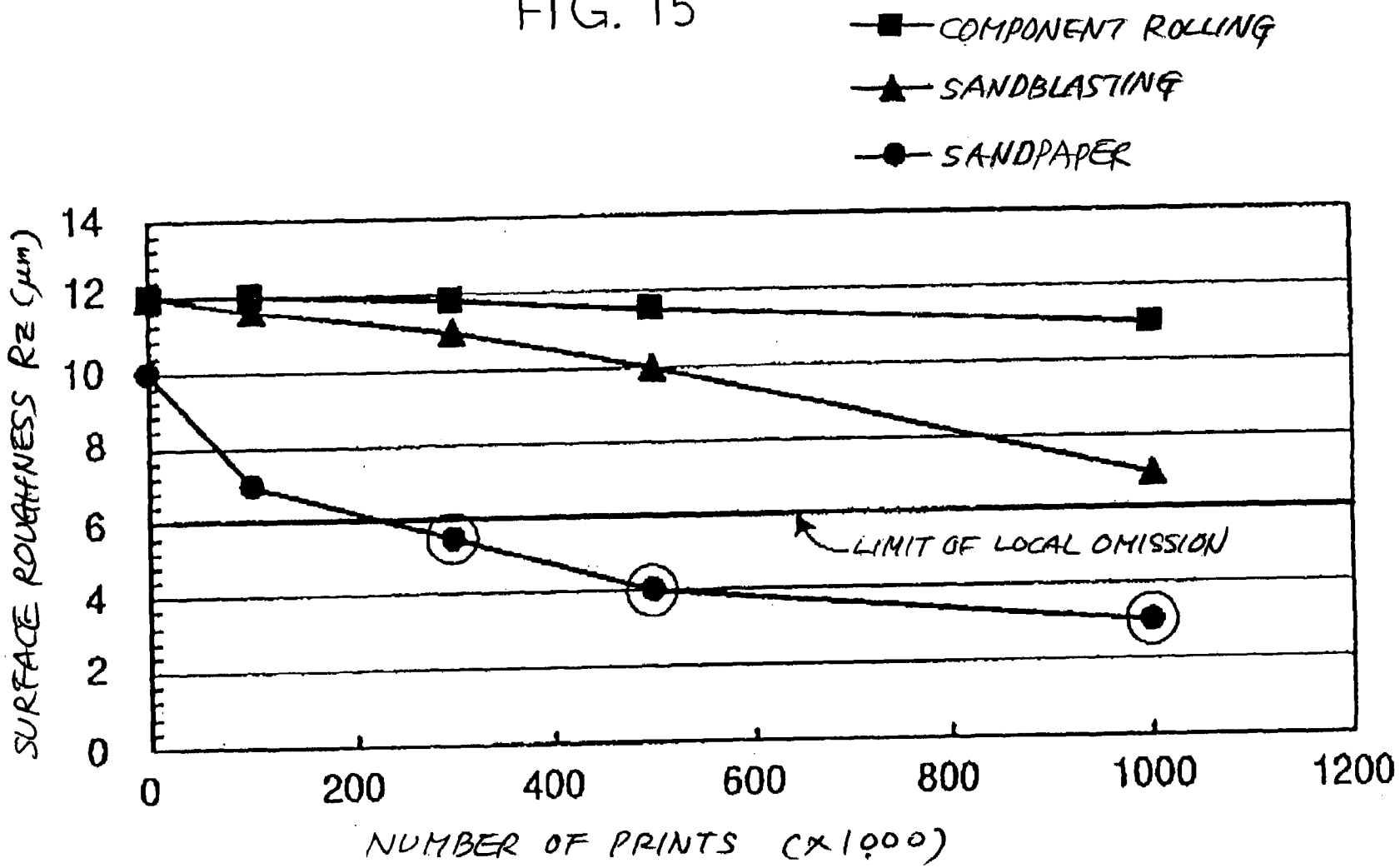
FIG. 15 is a graph showing the results of durability tests conducted with various backup rollers in the alternative embodiment.

FIG. 15 shows the results of durability tests. In FIG. 15, circles indicate points where the local omission of an image occurred. As shown, the backup roller whose surface was roughened by sandpaper caused local omission to occur when about 200,000 prints were produced. Ten-point mean surface roughness Rz, corresponding to 100,000 prints and 300,000 prints at both sides of 200,000 prints, were about 6.8 μm and about 5.5 μm, respectively. Therefore, surface roughness Rz intermediate between 6.8 μm and 5.5 μm is 6.15 μm that is substantially coincident with the allowable limit Rz of 6 μm determined by the experiments shown in FIG. 11. The surface roughness Rz of 6 μm may therefore be regarded as the limit.

In the following description, surface roughness will be represented by ten-point mean surface roughness Rz without exception.

The backup roller roughened by sandblasting maintained the surface roughness of 6 μm or above and did not bring about any local omission even when 1,000,000 prints were produced. However, after 1,000,000 prints, the surface roughness was found to be about 6.7 μm extremely close to the limit as to local omission. As FIG. 15 indicates, if more prints are continuously produced, then the surface roughness will soon reach the limit. It is to be noted that even the backup roller roughened by sandblasting can be sufficiently used only if it is replaced every time 1,000,000 prints are output. While the initial surface roughness was selected to be 12 μm in the experiments, the backup roller of this kind can be more safely used if the initial surface roughness is made larger than 12 μm.

On the other hand, the surface roughness Rz of the backup roller roughened by component rolling was reduced only by 1 μm when 1,000,000 prints were produced, maintaining a value far larger than the limit. This indicates that the backup roller roughened by component rolling in a crosshatch pattern has the highest durability presumably because the fine projections of the crosshatch pattern are hardened by component rolling. This effect is not attainable with sandpaper that simply removes part of the surface of the backup roller. Although sandblasting hardens recesses formed in the surface of the backup roller, it hardens only part of projections. This is presumably why projections formed by sandpaper and those formed by sandblasting both wore soon.

In the experiments, the surface roughness Rz of the backup roller roughened by component rolling was selected to be 12 μm. However, if the target durability is 1,000,000 prints and if surface roughness above the limit stated above should only be maintained when the target durability ends, then the initial surface roughness may even be around 7 μm. Stated another way, when surface roughness Rz is 12 μm, a sufficient margin is available as to both of toner scattering and local omission, so that sufficient image quality may be achieved even if the diameter of the drum is smaller than 40 mm used in the experiments.

As for the bias applying member, there may be used a brush, a Mylar sheet, a blade or similar conventional member in place of the image transfer roller, as will be described with reference to FIGS. 16 through 19 hereinafter. FIGS. 16 through 19 all show the second or magenta image forming station by way of example; the bias applying members each are provided with conductivity of a level generally referred to as medium resistance. In any case, high pressure should not be applied to the bias applying member in order to protect it from permanent set.

Figure 16:
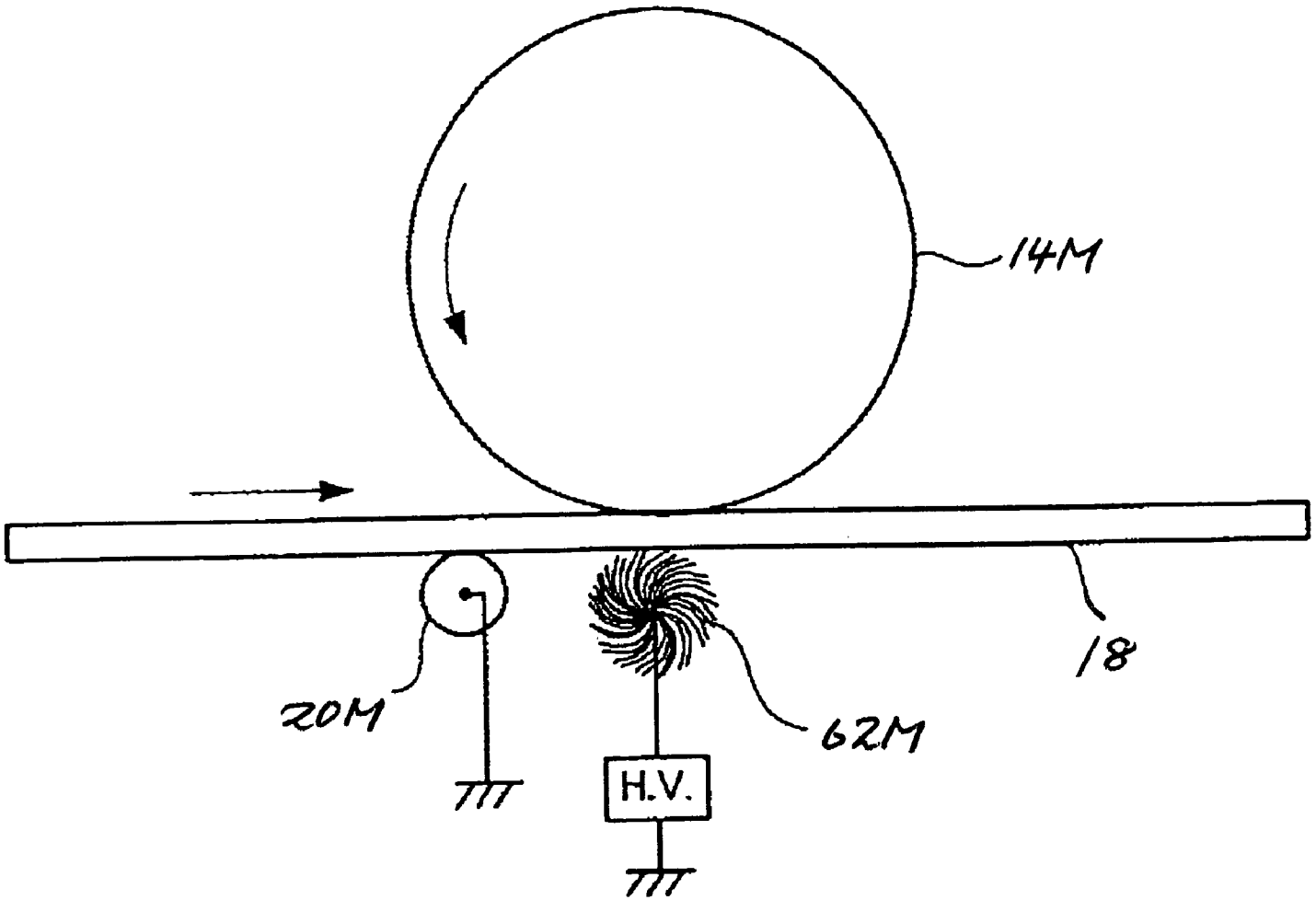
FIGS. 16 through 19 are views each showing a particular configuration of a bias applying member.
Figure 17:
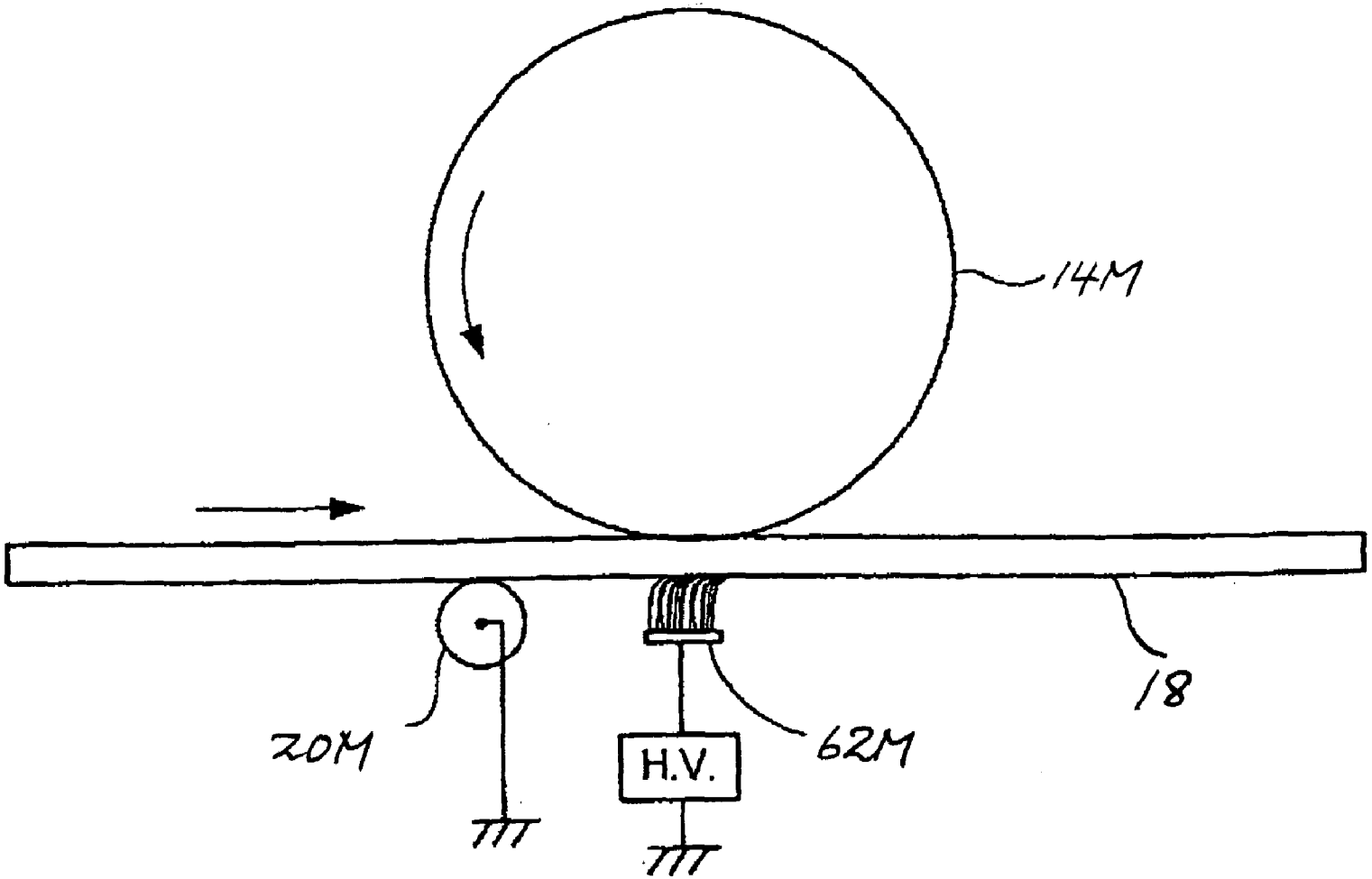
Figure 18:
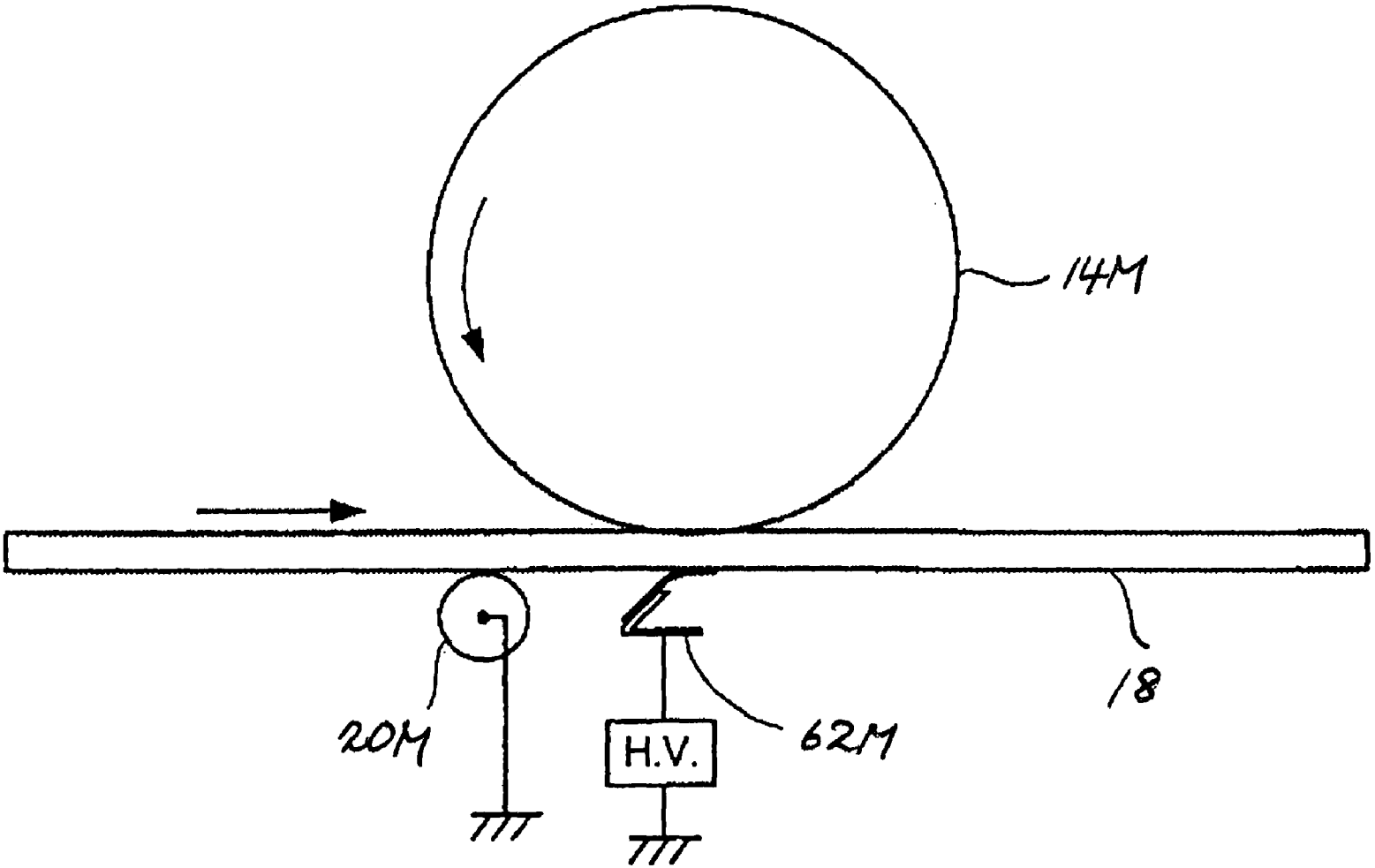
Figure 19:
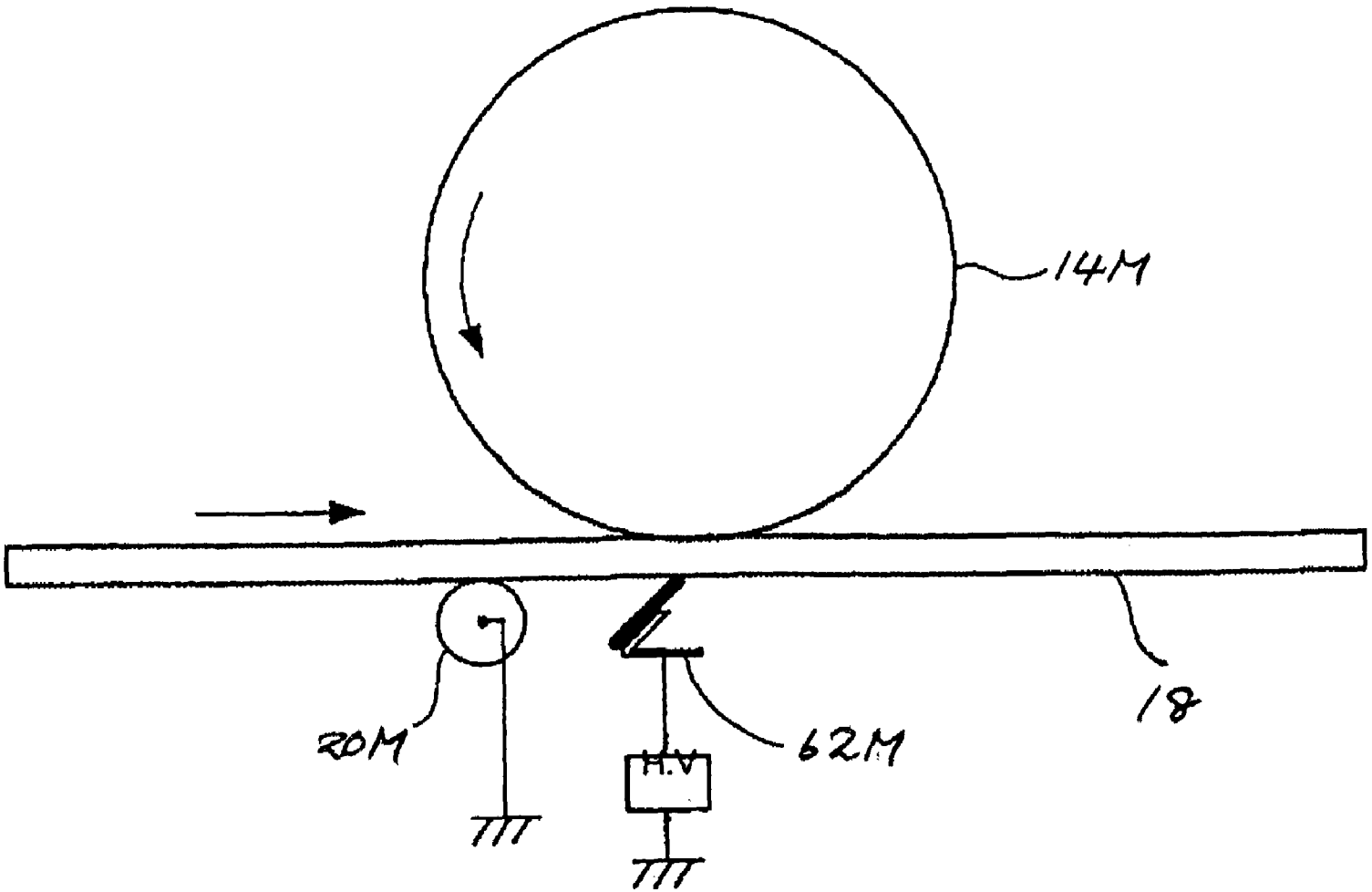

FIG. 16 shows a roller-like brush while FIG. 17 shows a simple strip-like brush. Further, FIGS. 18 and 19 show a thin Mylar sheet and a flat elastic member, respectively.

In the illustrative embodiment, too, the present invention is applied to the backup rollers or auxiliary rollers for forming image transfer nips at the inside of the loop of the image transfer belt. Presumably, by using discharge to occur between the backup roller and the image transfer belt, it is possible to discharge the image transfer belt. Therefore, the present invention may presumably be applicable even to rollers other than the backup rollers arranged in the image transferring unit for the purpose of effectively discharging the image transfer belt. Further, the illustrative embodiment is applicable to the direct image transfer type of tandem image forming apparatus stated earlier or an intermediate image forming apparatus including a single photoconductive drum.

As stated above, the illustrative embodiment effectively obviates image defects likely to occur in a low temperature, low humidity environment and including toner scattering of a bicolor text image and spot-like local omission of a halftone image.

Various modifications will become possible for those skilled in the art after receiving the teachings of the present disclosure without departing from the scope thereof.

What is claimed is:

1. In an image forming apparatus for sequentially transferring toner images from a plurality of image carriers to a sheet being conveyed by an image transfer belt one above the other with bias applying members to thereby form a composite color image, backup rollers, contacting an inside surface of said image transfer belt, each have a volumetric resistivity of $10^9$ Ω·cm or above and a surface roughness Rz of 6 μm or above, wherein:

said backup rollers, constituting auxiliary rollers for forming nips for image transfer, each are positioned close to the nip of a particular image transfer position at an upstream side of said nip in a direction of movement of said image transfer belt.

2. The apparatus as claimed in claim 1, wherein said bias applying members each comprise an elastic member configured to exert a suitable degree of pressure based on elasticity on an associated one of said plurality of image carriers via said image transfer belt.

3. The apparatus as claimed in claim 2, wherein said bias applying members each comprise a brush.

4. The apparatus as claimed in claim 2, wherein said bias applying members each comprise a Mylar sheet.

5. The apparatus as claimed in claim 2, wherein said bias applying members each comprise a blade.

6. The apparatus as claimed in claim 1, wherein said plurality of image carriers each have an outside diameter of 40 mm or below.

7. The apparatus as claimed in claim 1, wherein said image transfer belt has a volume resistivity of $10^{10}$ Ω·cm or above.

8. The apparatus as claimed in claim 1, wherein said apparatus is capable of forming images on both surfaces of a sheet.

9. The apparatus as claimed in claim 1, wherein said backup rollers each comprise a metallic core and a resin layer formed on said metallic core.

10. The apparatus as claimed in claim 1, wherein surfaces of said backup rollers are roughened by component rolling using a die.

11. In an image forming apparatus for sequentially transferring toner images from a plurality of image carriers to a sheet being conveyed by an image transfer belt one above the other with bias applying members to thereby form a composite color image, backup rollers, contacting an inside surface of said image transfer belt, each have a volumetric resistivity of $10^9$ Ω·cm or above and a surface roughness Ra of 1.5 μm or above, wherein said backup rollers, constituting auxiliary rollers for forming nips for image transfer, each are positioned close to the nip of a particular image transfer position at an upstream side of said nip in a direction of movement of said image transfer belt.

12. The apparatus as claimed in claim 11, wherein said bias applying members each comprise an elastic member configured to exert a suitable degree of pressure based on elasticity on an associated one of said plurality of image carriers via said image transfer belt.

13. The apparatus as claimed in claim 12, wherein said bias applying members each comprise a brush.

14. The apparatus as claimed in claim 13, wherein said bias applying members each comprise a Mylar sheet.

15. The apparatus as claimed in claim 13, wherein said bias applying members each comprise a blade.

16. The apparatus as claimed in claim 13, wherein said plurality of image carriers each have an outside diameter of 40 mm or below.

17. The apparatus as claimed in claim 12, wherein said image transfer belt has a volume resistivity of $10^{10}$ Ω·cm or above.

18. The apparatus as claimed in claim 11, wherein said apparatus is capable of forming images on both surfaces of a sheet.

19. The apparatus as claimed in claim 11, wherein said backup rollers each comprise a metallic core and a resin layer formed on said metallic core.

20. The apparatus as claimed in claim 11, wherein surfaces of said backup rollers are roughened by component rolling using a die.

21. In an image forming apparatus for sequentially transferring a plurality of toner images of different colors from an image carrier to an intermediate image transfer belt one above the other with a bias applying member to thereby form a composite color image and then transferring said composite color image to a recording medium, a high-resistance backup roller, contacting an inside surface of said intermediate image transfer belt, has a volumetric resistivity of $10^{10}$ Ω·cm or above and a ten-point mean surface roughness Rz of 6 μm or above or an arithmetic mean surface roughness Ra of 1.5 μm or above, wherein:

said intermediate image transfer belt has a surface resistivity of $10^{12}$ Ω·cm$^2$ or above.

22. The apparatus as claimed in claim 21, wherein said image carrier comprises a plurality of image carriers each being assigned to a particular color, and said high-resistance backup roller, constituting an auxiliary roller for forming a nip for image transfer, comprises a plurality of high-resistance backup-rollers each being positioned close to said nip at an upstream side of said nip in a direction of movement of said intermediate image transfer belt.

23. The apparatus as claimed in claim 21, wherein said bias applying member contacts the inside surface of said intermediate image transfer belt and presses said intermediate image transfer belt against said image carrier with preselected pressure based on elasticity of said bias applying means.

24. The apparatus as claimed in claim 21, wherein said bias applying member comprises a roller.

25. The apparatus as claimed in claim 21, wherein said bias applying member comprises a brush.

26. The apparatus as claimed in claim 21, wherein said bias applying member comprises a Mylar sheet.

27. The apparatus as claimed in claim 21, wherein said bias applying member comprises a blade.

28. The apparatus as claimed in claim 21, wherein said image carrier has an outside diameter of 40 mm or below.

29. The apparatus as claimed in claim 21, wherein said high-resistance backup roller comprises a metallic core and a resin layer formed on said metallic core.

30. The apparatus as claimed in claim 21, wherein a surface layer of said high-resistance backup roller is provided with an initial ten-point mean roughness Rz of 12 μm or above by sandblasting.

31. The apparatus as claimed in claim 21, wherein a surface of said high-resistance backup roller is roughened to have a preselected roughness by sandblasting.

32. The apparatus as claimed in claim 21, wherein a surface of said high-resistance backup roller is provided with an initial ten-point mean roughness Rz of 7 μm or above.

33. In an intermediate image transfer belt for carrying a composite color image, which is formed by transferring a plurality of toner images of different colors from an image carrier one above the other, and transferring said composite color image to a recording medium, a high-resistance backup roller, contacting an inside surface of said intermediate image transfer belt, has a volumetric resistivity of $10^{10}$ Ω·cm or above and a ten-point mean surface roughness Rz of 6 μm or above or an arithmetic mean surface roughness Ra of 1.5 μm or above, wherein:

said intermediate image transfer belt has a surface resistivity of $10^{12}$ $\Omega m^2$ or above.

34. In an image forming apparatus for sequentially transferring toner images from a plurality of image carriers to a sheet being conveyed by an image transfer belt, backup rollers, each having a volumetric resistivity of at least $10^9$ Ω·cm, contacting an inside surface of said image transfer belt and constituting auxiliary rollers for forming nips for image transfer, each are positioned close to the nip of a particular image transfer position at an upstream side of said nip in a direction of movement of said image transfer belt.

35. In an image forming apparatus for sequentially transferring a plurality of toner images of different colors from an image carrier to an intermediate image transfer belt one above the other with a bias applying member to thereby form a composite color image and then transferring said composite color image to a recording medium, high-resistance backup rollers having a volumetric resistivity of at least $10^9$ Ω·cm, contacting an inside surface of said intermediate image transfer belt, wherein said intermediate image transfer belt has a surface resistivity of $10^{12}$ Ω·cm or above wherein said backup rollers, constituting auxiliary rollers for forming nips for image transfer, each are positioned close to the nip of a particular image transfer position at an upstream side of said nip in a direction of movement of said image transfer belt.

36. In an image forming apparatus for sequentially transferring a plurality of toner images of different colors from an image carrier to an intermediate image transfer belt one above the other with a bias applying member to thereby form a composite color image and then transferring said composite color image to a recording medium, a high-resistance backup roller, contacting an inside surface of said intermediate image transfer belt, wherein said image earner comprises a plurality of image carriers each being assigned to a particular color, and said high-resistance backup roller, constituting an auxiliary roller for forming a nip for image transfer, comprises a plurality of high-resistance backup-rollers each being positioned close to said nip at an upstream side of said nip in a direction of movement of said intermediate image transfer belt and having a volumetric resistivity of at least $10^9$ Ω·cm.

* * * * *